US010882321B2

(12) United States Patent
Yamaguchi et al.

(10) Patent No.: US 10,882,321 B2
(45) Date of Patent: Jan. 5, 2021

(54) LIQUID SUPPLIER, LIQUID SUPPLY SYSTEM, AND METHOD OF MANUFACTURING LIQUID SUPPLIER

(71) Applicant: SEIKO EPSON CORPORATION, Tokyo (JP)

(72) Inventors: Manabu Yamaguchi, Shiojiri (JP); Hiroyuki Kawate, Hokuto (JP); Takumi Nagashima, Matsumoto (JP); Hiroyoshi Ozeki, Shiojiri (JP); Taku Ishizawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/393,473

(22) Filed: Apr. 24, 2019

(65) Prior Publication Data

US 2019/0329558 A1 Oct. 31, 2019

(30) Foreign Application Priority Data

Apr. 26, 2018 (JP) ..... 2018-084781

(51) Int. Cl.
*B41J 2/175* (2006.01)
*B41J 29/13* (2006.01)
*B41J 29/02* (2006.01)

(52) U.S. Cl.
CPC ..... *B41J 2/175* (2013.01); *B41J 2/1752* (2013.01); *B41J 2/1753* (2013.01);
(Continued)

(58) Field of Classification Search
CPC .... B41J 2/175; B41J 2/17513; B41J 2/17523; B41J 2/1752; B41J 2/1753; B41J 2/17553;
(Continued)

(56) References Cited

U.S. PATENT DOCUMENTS 7,566,120 B2 * 7/2009 Ishizawa ..... B41J 2/17553 347/86
7,677,710 B2 * 3/2010 Kobayashi ..... B41J 2/175 347/85
(Continued)

FOREIGN PATENT DOCUMENTS

JP 2007-145032 A 6/2007
JP 2009-279876 A 12/2009
(Continued)

*Primary Examiner* — Anh T Vo
(74) *Attorney, Agent, or Firm* — Oliff PLC

(57) ABSTRACT

A liquid supplier can be attached to and detached from a case of a liquid ejection device, and includes a connection member located at an end of the case. The connection member includes a liquid outlet member including a liquid outlet port and a connection port, a container-side electric connector, a first receiving portion that receives a first positioning portion of the liquid ejection device, and a second receiving portion that receives a second positioning portion of the liquid ejection device. The width of the liquid supplier in the Z direction is smaller than a width in the Y direction and a width in the X direction. The liquid supplier further includes a tube whose one end is connected to the connection port, and into which liquid is injected from another end that is located outside the liquid ejection device.

6 Claims, 31 Drawing Sheets

(52) U.S. Cl.
CPC ..... *B41J 2/17513* (2013.01); *B41J 2/17523* (2013.01); *B41J 2/17553* (2013.01); *B41J 2/17556* (2013.01); *B41J 29/02* (2013.01); *B41J 29/13* (2013.01); *B41J 2002/17516* (2013.01)

(58) Field of Classification Search
CPC ..... B41J 2/17556; B41J 29/02; B41J 29/13; B41J 2002/17516
See application file for complete search history.

(56) References Cited

U.S. PATENT DOCUMENTS

| | | | | |
|---|---|---|---|---|
| 8,220,909 | B2 | 7/2012 | Domae | |
| 9,162,466 | B2 | 10/2015 | Nagashima et al. | |
| 9,902,159 | B2 | 2/2018 | Hatano et al. | |
| 2003/0071874 | A1* | 4/2003 | Ishizawa | B41J 2/17596 347/50 |
| 2003/0076391 | A1* | 4/2003 | Wilson | B41J 2/175 347/86 |
| 2012/0212526 | A1* | 8/2012 | Karasawa | B41J 2/17509 347/7 |
| 2013/0169720 | A1* | 7/2013 | Nakamura | B41J 2/175 347/86 |
| 2017/0246875 | A1* | 8/2017 | Nose | B41J 2/1752 |
| 2018/0043694 | A1 | 2/2018 | Toya et al. | |
| 2018/0043695 | A1 | 2/2018 | Kawate et al. | |
| 2018/0104955 | A1 | 4/2018 | Kawate et al. | |

FOREIGN PATENT DOCUMENTS

| | | | |
|---|---|---|---|
| JP | 2015-074103 | A | 4/2015 |
| JP | 2017-043054 | A | 3/2017 |
| JP | 2018-024195 | A | 2/2018 |
| JP | 2018-027680 | A | 2/2018 |
| JP | 2018-065373 | A | 4/2018 |

* cited by examiner

LIQUID SUPPLIER, LIQUID SUPPLY SYSTEM, AND METHOD OF MANUFACTURING LIQUID SUPPLIER

The present application is based on, and claims priority from JP Application Serial Number 2018-084781, filed Apr. 26, 2018, the disclosure of which is hereby incorporated by reference herein in its entirety.

BACKGROUND

1. Technical Field

The present disclosure relates to a liquid supplier.

2. Related Art

A liquid container that is detachably attached to a liquid ejection device has been widely used as a liquid supplier that is used to supply liquid to a liquid ejection device. For example, a liquid container disclosed in JP-A-2009-279876, JP-A-2017-43054, and JP-A-2018-027680 includes a flexible bag, and liquid to be supplied to a liquid ejection device is contained in the bag.

Normally, when the remaining amount of liquid has decreased below a pre-determined lower limit amount, the liquid container described above is removed from a liquid ejection device, and is replaced with a new liquid container. Such repetition of replacement of the liquid container incurs an increase in the operation cost of the liquid ejection device. Therefore, there has been desire for a technology with which liquid can be continuously supplied to a liquid ejection device without replacing or disposing the liquid container.

SUMMARY

One aspect of this disclosure is provided as a liquid supplier. A direction parallel to a gravity direction is defined as a Z direction, a direction of the Z direction that is the same as the gravity direction is defined as a +Z direction, a direction of the Z direction that is opposite to the gravity direction is defined as a −Z direction, a direction orthogonal to the Z direction is defined as a Y direction, one direction of the Y direction is defined as a +Y direction, the other direction of the Y direction is defined as a −Y direction, a direction orthogonal to the Z direction and the Y direction is defined as a X direction, one direction of the X direction is defined as a +X direction, and the other direction of the X direction is defined as a −X direction. A liquid supplier of this aspect can be attached to and detached from a case of a liquid ejection device that includes: a housing provided with a case storage inside the housing; the case that moves along the +Y direction in order to be inserted into the case storage; a liquid introduction member located at an end of the case storage on the +Y direction side; a device-side electric connector located at the end of the case storage on the +Y direction side; and a first positioning portion and a second positioning portion that extend from the end of the case storage on the +Y direction side toward the −Y direction side, and are provided at positions, which are separated from each other in the X direction, that sandwich the liquid introduction member. The liquid supplier includes a connection member located at an end of the case on the +Y direction side when the liquid supplier is in an attached state of being attached to the liquid ejection device. The connection member includes: a liquid outlet member that includes, in the attached state, a liquid outlet port to which the liquid introduction member is inserted in the +Y direction, and a connection port being in communication with the liquid outlet port at an end on the −Y direction side, and leads out liquid to be supplied to the liquid ejection device; a container-side electric connector that, in the attached state, comes into electrical contact with the device-side electric connector while receiving at least a force having a component in the +Z direction from the device-side electric connector; a first receiving portion that receives the first positioning portion in the attached state; and a second receiving portion that receives the second positioning portion in the attached state. A width of the liquid supplier in the Z direction being smaller than a width in the Y direction and a width in the X direction in an orientation in the attached state. The liquid supplier includes a tube whose one end is coupled to the connection port, and into which the liquid is injected from another end located outside the liquid ejection device in the attached state.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

1. First Embodiment

(1) Introduction

Figure 1:
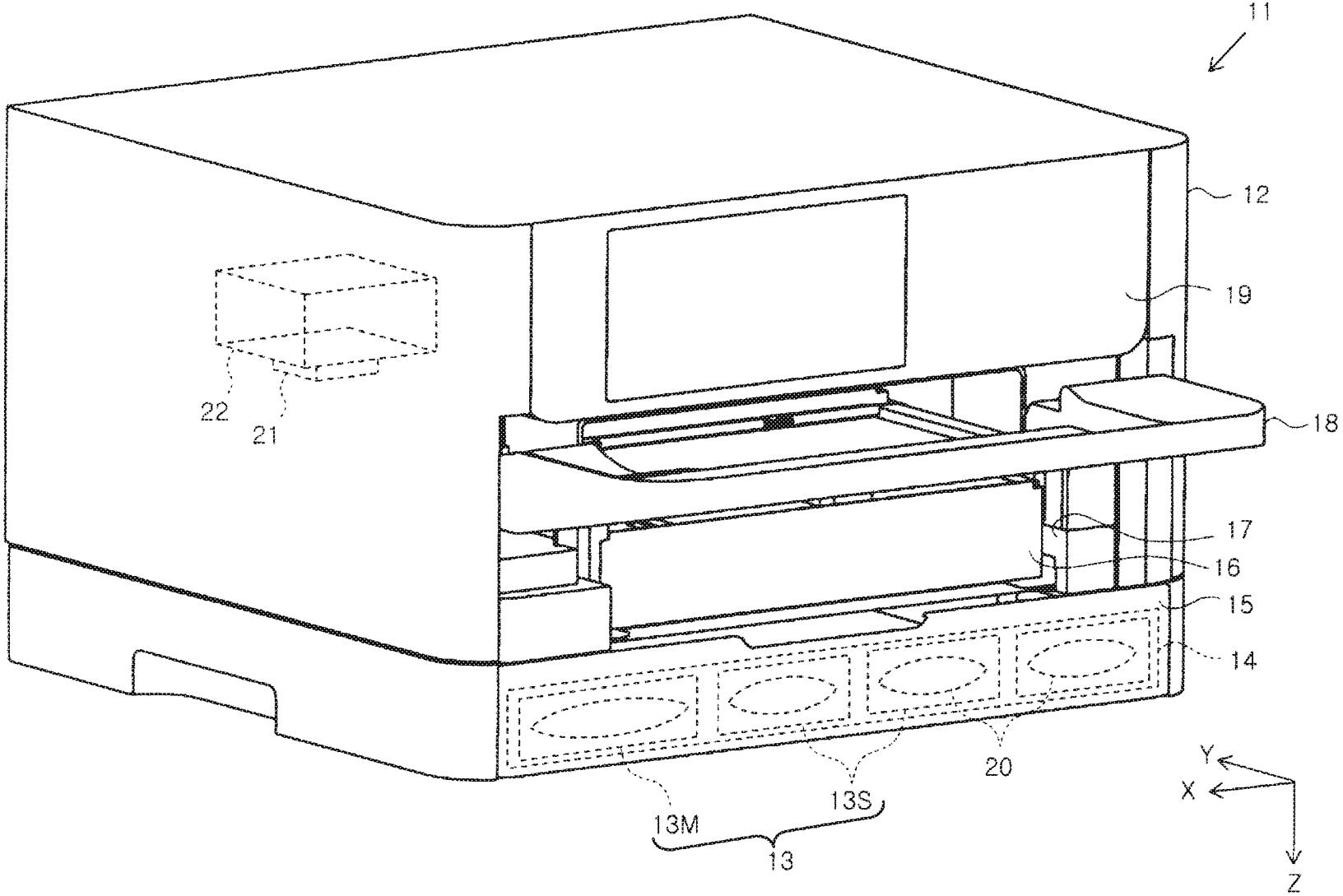
FIG. 1 is a schematic perspective view of a liquid ejection device.

A liquid supplier 210 (refer to FIG. 22) of a first embodiment is manufactured using a liquid container 20 that is attached to a liquid ejection device 11. In the following, the configuration of the liquid ejection device 11 will be described with reference to FIGS. 1 to 3, and the configuration of an attachment body 50 including the liquid container 20 will be described with reference to FIGS. 4 to 19. Thereafter, the manufacturing method of the liquid supplier 210 using the liquid container 20 and the configuration of the liquid supplier 210 will be described with reference to FIGS. 20 to 22, and the configuration of the liquid supply system 301 including the liquid supplier 210 will be described with reference to FIG. 23.

(2) Configuration of Liquid Ejection Device

FIG. 1 is a schematic perspective view of the liquid ejection device 11. The liquid ejection device 11 is an inkjet printer that forms a print image by recording dots that are formed by ejecting ink, which is an example of liquid, onto a medium such as paper.

The liquid ejection device 11 includes a housing 12, which is an exterior body having a substantially rectangular parallelepiped shape. A case storage 14 that can detachably accommodate a case 13 is provided inside the housing 12. In a front face portion of the housing 12, a front cover 15 that rotates so as to open and close the case storage 14 and an attachment port 17 through which a cassette 16 that can store a medium (not illustrated) is attached are arranged in the stated order upward from the bottom side. Furthermore, a discharge tray 18 to which a medium is discharged and an operation panel 19 for a user to operate the liquid ejection device 11 are arranged above the attachment port 17. Note that the front face of the housing 12 refers to a side face that has a height and a width, and is assumed to be directly faced by the user when operating the liquid ejection device 11.

A plurality of cases 13 can be attached to the case storage 14 of this embodiment in a mode of being arranged side by side in a width direction. For example, three or more cases 13 including a first case 13S and a second case 13M whose width is larger than the first case 13S are attached to the case storage 14 as the plurality of cases 13. Also, liquid containers 20 are detachably mounted in these cases 13. That is, the liquid container 20 is mounted in the case 13 that is detachably attached to the liquid ejection device 11. The case 13 can be attached to the case storage 14 even in a state in which the liquid container 20 is not held, and is a constituent element included in the liquid ejection device 11.

A liquid ejector 21 that ejects liquid from a nozzle and a carriage 22 that moves back and forth along a scanning direction that matches the width direction of the liquid ejection device 11 are provided inside the housing 12. The liquid ejector 21 moves along with the carriage 22, and performs printing on a medium by ejecting liquid that is supplied from the liquid container 20 mounted in the case 13 to the medium. Note that, in other embodiments, the liquid ejector 21 may be a line head that does not move back and forth and whose position is fixed.

In this embodiment, a direction that intersects the movement path when the case 13 is attached to the case storage 14 is the width direction, and a direction in which the movement path extends is a depth direction. Note that it is preferable that the movement path and the width direction orthogonally intersect. The width direction and the depth direction substantially extend along a horizontal plane. In the diagram, the gravity direction in a normal use state in which the liquid ejection device 11 is placed on a horizontal plane is indicated by a Z axis, and the movement direction when the case 13 is attached to the case storage 14 is indicated by a Y axis. The movement direction may also be expressed as an attachment direction or an insertion direction to the case storage 14, and the direction opposite to the movement direction may also be expressed as a removal direction. Also, the width direction is indicated by an X axis that is orthogonal to the Z axis and Y axis. The width direction, the gravity direction, and the attachment direction intersect each other, and are respectively directions when the lengths of width, height, and depth are expressed. Note that the width direction, the gravity direction, and the attachment direction preferably orthogonally intersect each other.

In the following description, the liquid ejection device 11 is assumed to be in a normal use state, unless it is specifically stated otherwise. Also, a direction parallel to the Z axis is referred to as a Z direction, and of the Z direction, a direction that is the same as the gravity direction is also referred to as a +Z direction, and a direction opposite to the gravity direction is referred to as a −Z direction. Also, a direction parallel to the Y axis is referred to as a Y direction, one direction of the Y direction is referred to as a +Y direction, and the other direction is referred to as a −Y direction. A direction parallel to the X axis is referred to as an X direction, one direction of the X direction is referred to as a +X direction, and the other direction is also referred to as a −X direction. The +Y direction is a direction in which the case 13 moves when the case 13 is inserted to the case storage 14.

Figure 2:
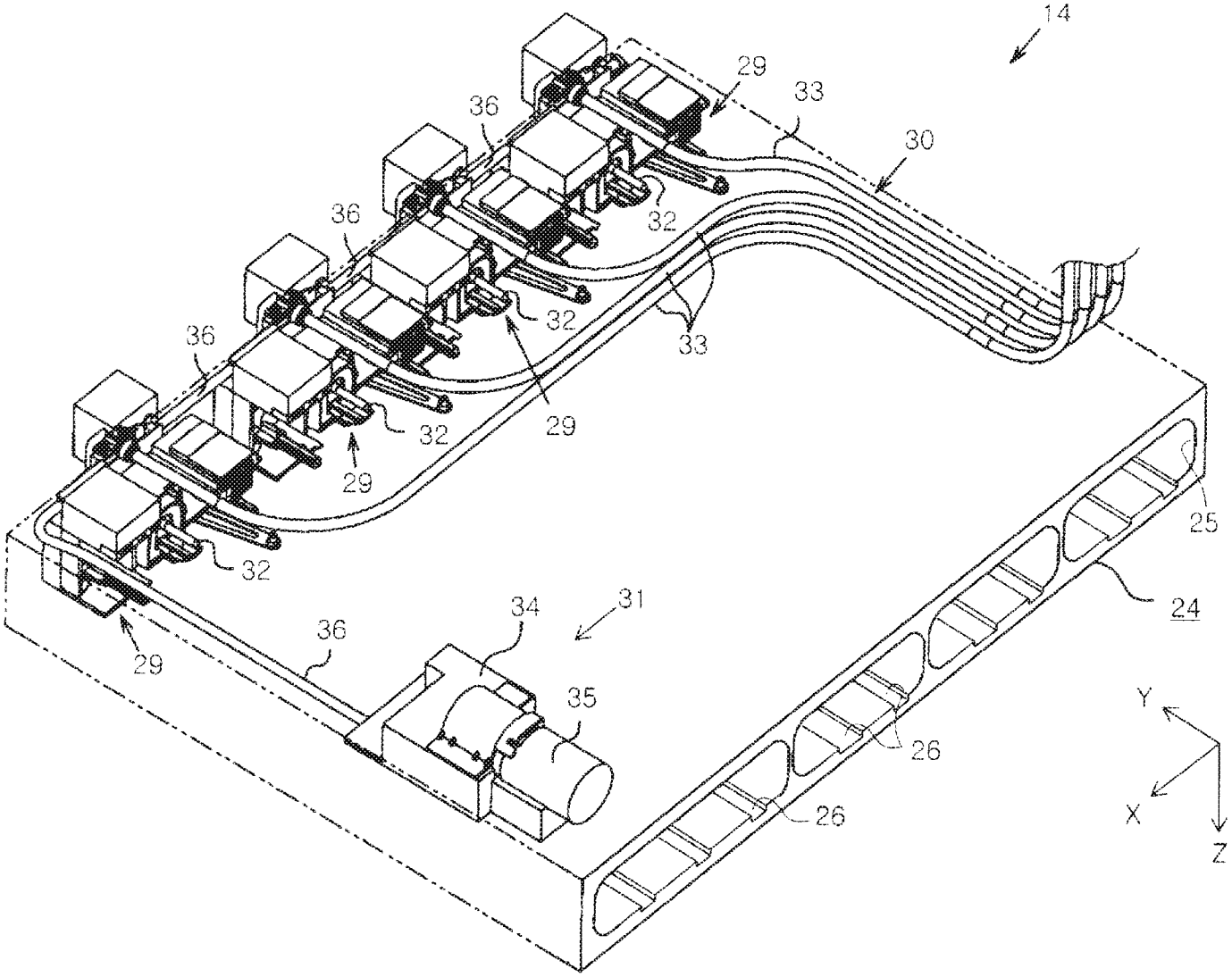
FIG. 2 is a schematic perspective view of a case storage.

FIG. 2 is a schematic perspective view of the case storage 14. The case storage 14 provides a space in which one or more cases 13 can be accommodated. In this embodiment, the case storage 14 can accommodate four cases 13. A frame body 24 is arranged on the −Y direction side of the case storage 14. The frame body 24 includes insertion ports 25 that are in communication with the case storage 14 and are for inserting the cases 13 to the case storage 14. The frame body 24 preferably includes a plurality of sets of line-shaped guide rails 26, for guiding movements of the cases 13 when attached or removed, that are each constituted by at least one protruded shape or recessed shape that extends in the depth direction.

Each case 13 moves through one insertion port 25 along the +Y direction, and is attached to the case storage 14. Note that, in FIG. 2, only the vicinity of a front plate, of the frame body 24, that forms the insertion ports 25 are illustrated by solid lines. One or more connection mechanisms 29 are provided so as to correspond to respective cases 13 at an end of the case storage 14 in the +Y direction. In this embodiment, four connection mechanisms 29 are provided.

The liquid ejection device 11 includes supply channels 30 that supply liquid from the liquid containers 20 that are attached to the case storage 14 together with the cases 13 toward the liquid ejector 21, and a supply mechanism 31 configured to feed liquid contained in the liquid containers 20 to the supply channels 30.

The supply channels 30 are provided for respective types of liquid, and each include a liquid introduction member 32 to which the liquid container 20 is to be coupled and a flexible supply tube 33. In this embodiment, the supply channels 30 are provided for respective ink colors. Each liquid introduction member 32 is constituted by a needle-shaped tube member that extends in the −Y direction. Pump chambers (not illustrated) are provided between the respective liquid introduction members 32 and supply tubes 33. A downstream end of each liquid introduction member 32 and an upstream end of the corresponding supply tube 33 are in communication with the corresponding pump chamber. Each pump chamber is partitioned from a pressure change chamber that is not illustrated by a flexible film (illustration omitted).

The supply mechanism 31 includes a pressure change mechanism 34, a driving source 35 of the pressure change mechanism 34, and a pressure change channel 36 that connects the pressure change mechanism 34 and the pressure change chambers. The driving source 35 is constituted by a motor, for example. When the pressure change mechanism 34 depressurizes a pressure change chamber through the pressure change channel 36 due to driving of the driving source 35, the flexible film warps and shifts to the pressure change chamber side, and thus the pressure in the pump chamber decreases. As a result of the reduction in the pressure in the pump chamber, liquid contained in the liquid container 20 is suctioned to the pump chamber through the liquid introduction member 32. This is called suction driving. Thereafter, when the pressure change mechanism 34 cancels the decompression in the pressure change chamber through the pressure change channel 36, the flexible film warps and shifts to the pump chamber side, and thus the pressure in the pump chamber increases. As a result of the increase in the pressure in the pump chamber, the liquid in the pump chamber then flows out to the supply tube 33 in a state of being pressurized. This is called discharge driving. The supply mechanism 31 supplies liquid from the liquid container 20 to the liquid ejector 21 by alternately repeating the suction driving and the discharge driving.

Figure 3:
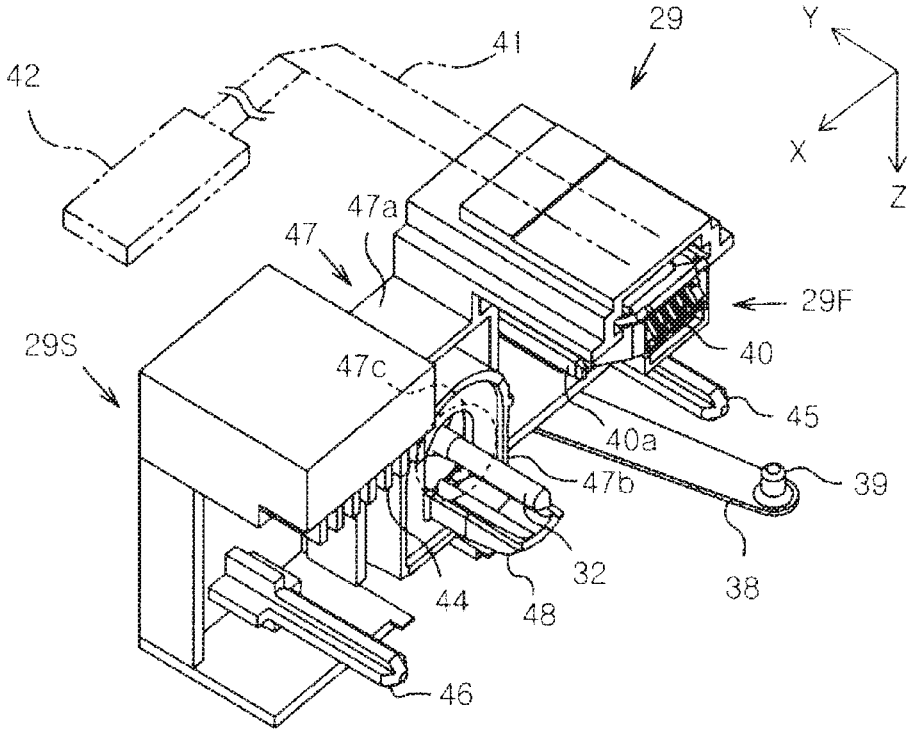
FIG. 3 is a schematic perspective view of a connection mechanism.

FIG. 3 is a schematic perspective view of each connection mechanism 29. The connection mechanism 29 includes a first connection mechanism 29F and a second connection mechanism 29S respectively at positions that sandwich the liquid introduction member 32 in the width direction. The first connection mechanism 29F includes a device-side fixing structure 38. The device-side fixing structure 38 engages with a later-described case-side fixing structure of a case 13 in an accommodated state in which the case 13 is attached to the case storage 14, and restricts movement of the case 13 in the −Y direction. In the first embodiment, the device-side fixing structure 38 is constituted by an arm-shaped member. The device-side fixing structure 38 is arranged vertically lower than the liquid introduction member 32, and protrudes in the −Y direction, which is a removal direction of the case 13. The device-side fixing structure 38 is configured such that the leading end rotates about the base end. A locking portion 39 is provided at the leading end of the device-side fixing structure 38. The locking portion 39 is arranged on a movement path of the case 13 when the case 13 is attached to the case storage 14 (refer to FIG. 2). In the first embodiment, the locking portion 39 is constituted as a protruded part that protrudes vertically upward from the device-side fixing structure 38.

The first connection mechanism 29F includes a device-side electric connector 40. The device-side electric connector 40 is arranged vertically above the liquid introduction member 32, and protrudes in the −Y direction, which is the removal direction. The device-side electric connector 40 is coupled to a control device 42 via an electric line 41 such as a flat cable. The device-side electric connector 40 is arranged such that the upper end protrudes in the removal direction than the lower end so as to face obliquely downward. Also, a pair of guide projections 40*a* that protrude in the width direction and extends along the attachment direction are arranged on both sides of the device-side electric connector 40 in the width direction.

The second connection mechanism 29S includes a block 44 for preventing erroneous insertion that is arranged vertically above the liquid introduction member 32 and protrudes in the removal direction. The block 44 includes an uneven shape that is arranged so as to face downward. The shape of uneven shape differs for each connection mechanism 29 that is arranged in the case storage 14.

The connection mechanism 29 includes a pair of positioning portions 45 and 46. A first positioning portion 45 is included in the first connection mechanism 29F, and the second positioning portion 46 is included in the second connection mechanism 29S. The first positioning portion 45 and the second positioning portion 46 are each configured as a shaft-shaped part that extends toward the −Y direction side, and are respectively provided at positions that are separate from each other in the X direction so as to sandwich the liquid introduction member 32. The projection length of each of the positioning portions 45 and 46 in the removal direction is preferably larger than the projection length of the liquid introduction member 32 in the removal direction.

The connection mechanism 29 further includes an extrusion mechanism 47 that is arranged so as to surround the liquid introduction member 32, and a liquid receiving portion 48 that protrudes in the removal direction below the liquid introduction member 32. The extrusion mechanism 47 includes a frame member 47*a* that surrounds a base end of the liquid introduction member 32, a pressing portion 47*b* that protrudes in the removal direction from the frame member 47*a*, and a biasing portion 47*c* that biases the case 13 in the removal direction via the pressing portion 47*b*. The biasing portion 47*c* may be a coil spring that is interposed between the frame member 47*a* and the pressing portion 47*b*, for example.

As described above, the connection mechanisms 29 are located at the end of the case storage 14 on the +Y direction side (refer to FIG. 2). Therefore, the liquid introduction member 32 and the device-side electric connector 40 that are included in each connection mechanism 29 are located at the end of the case storage 14 on the +Y direction side. Also, the liquid introduction member 32, the device-side fixing structure 38, the first positioning portion 45, and the second positioning portion 46 extend from the end of the case storage 14 on the +Y direction side toward the −Y direction side.

(3) Configuration of Attachment Body

Figure 4:
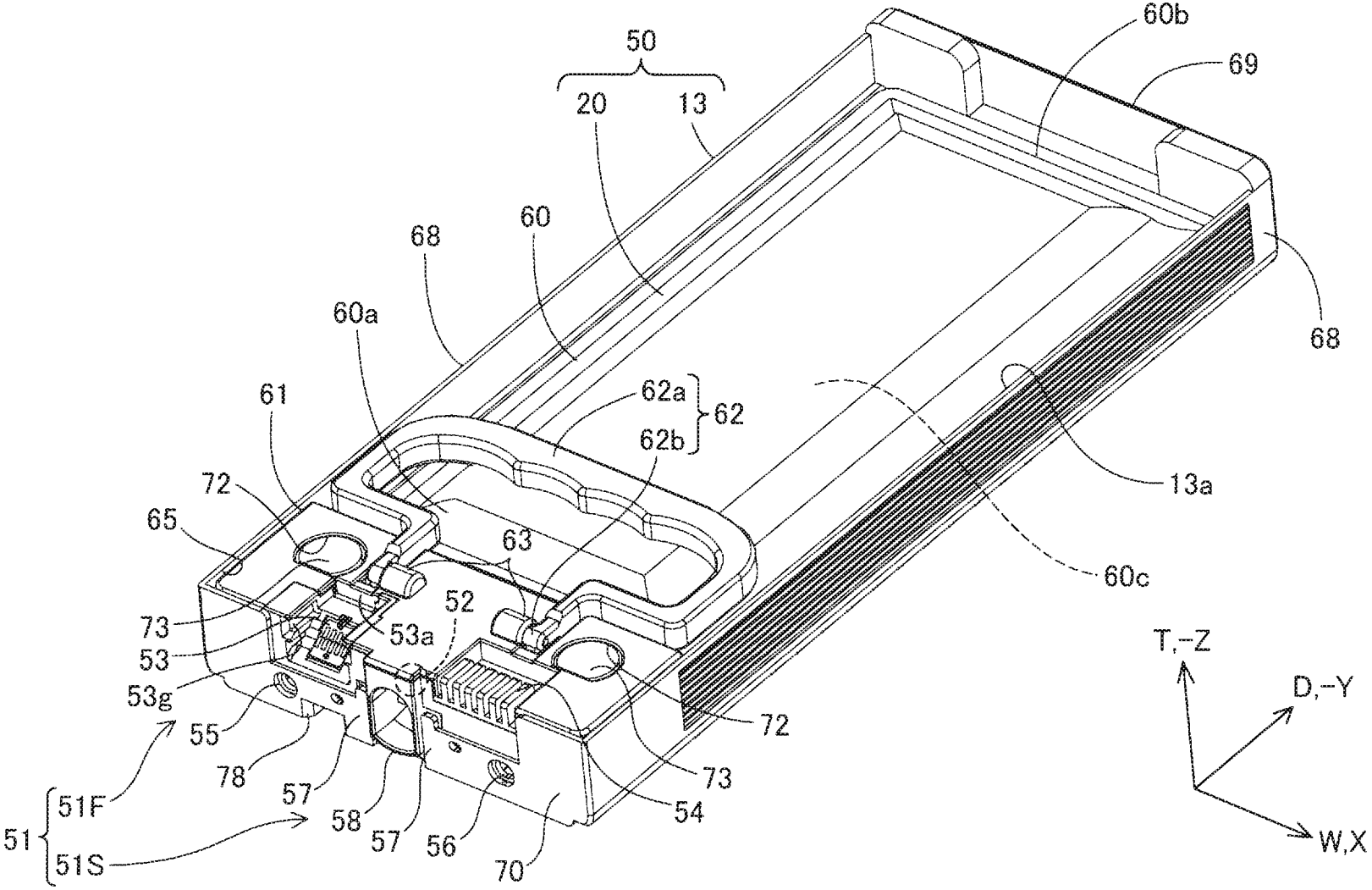
FIG. 4 is a schematic perspective view of an attachment body.
Figure 5:
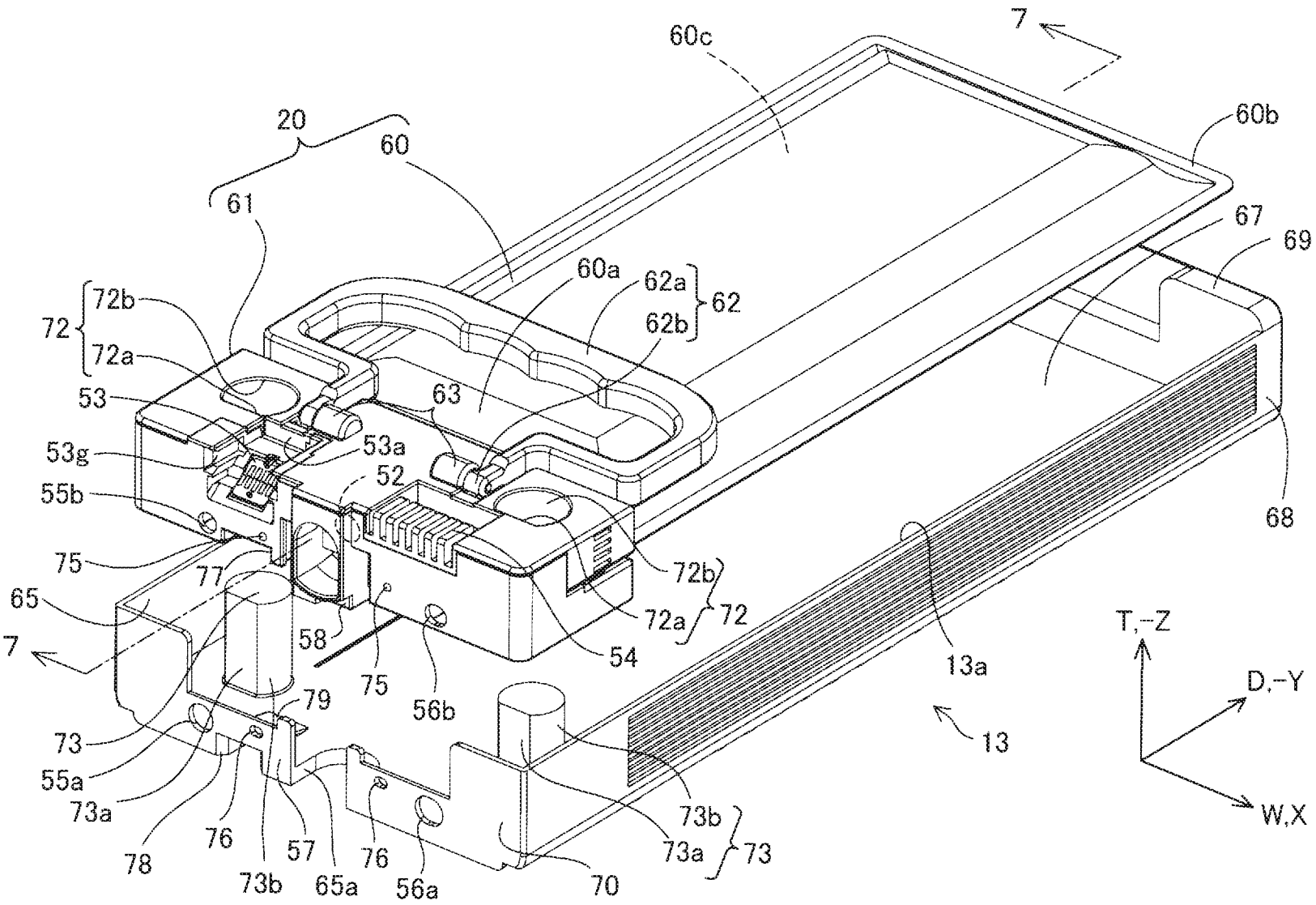
FIG. 5 is a schematic exploded perspective view of the attachment body.

FIG. 4 is a schematic perspective view of the attachment body 50 to be attached to the case storage 14. In this embodiment, the attachment body 50 is constituted by a case 13 having a substantially rectangular parallelepiped external shape, and a liquid container 20 that is mounted in the case 13. FIG. 4 and later-described FIG. 5 show perspective views of the second case 13M as the case 13. Hereinafter, the state in which the liquid container 20 that is in a state of being arranged in the case 13, as shown in FIG. 4, is attached to the liquid ejection device 11 that is in a normal use state is referred to as "attached state".

The liquid container 20 is for supplying liquid including sedimentary component to the liquid ejection device 11. The liquid container 20 includes a containing portion 60 that contains liquid, and a connection member 61 that is attached to an end of the containing portion 60 on the +Y direction side.

The containing portion 60 is constituted by a flexible bag. The containing portion 60 of this embodiment is a pillow type bag that is formed by stacking two rectangular films and joining the peripheral edges of the films to each other. In another embodiment, the containing portion 60 may be a gusset type. The film that constitutes the containing portion 60 is made of a material that has flexibility and gas barrier properties. Examples of the material of the films include polyethylene terephthalate (PET), nylon, polyethylene, and the like. Also, the film may be formed using a laminated structure in which a plurality of films made of these materials are laminated. In such a laminated structure, the outer layer is made of PET or nylon that has excellent impact resistance, and the inner layer is made of polyethylene that has excellent ink resistance, for example. Furthermore, a film including a layer acquired by vapor depositing aluminum or the like may be one constituent member of the laminated structure.

The containing portion 60 includes, inside thereof, an inner space 60*c* for containing liquid. Ink, as the liquid, in which pigment as a sedimentary component is dispersed in a solvent is contained in the inner space 60*c*. The containing portion 60 includes one end portion 60*a* and another end portion 60*b* that opposes to the one end portion 60*a*. The connection member 61 is attached to the one end portion 60*a* of the containing portion 60. The connection member 61 includes a liquid outlet port 52, which is a supply port for guiding out the liquid inside the inner space 60*c* to the liquid ejection device 11.

FIG. 4 shows three directions orthogonal to each other, namely, a D direction, a T direction, and a W direction. In this embodiment, the D direction is a direction that is along the Y direction shown in FIG. 1, and in which the containing portion 60 extends. In the following description, a direction, of the D direction, from the liquid outlet portion 52 toward the other edge portion 60*b* side of the containing portion 60 is defined as a +D direction, and the direction opposite to the +D direction is defined as a −D direction. Also, a direction in which the dimension of the outer shape of the liquid container 20 is smallest is defined as the T direction. A direction orthogonal to the D direction and the T direction is defined as the W direction. In this embodiment, the T direction is a direction along the Z direction, and a +T direction corresponds to the −Z direction. Also, the W direction is a direction along the X direction, and a +W direction corresponds to the +X direction.

When the end of the attachment body 50 on the +Y direction side that is inserted first when the attachment body 50 is attached to the case storage 14 (refer to FIG. 2) is denoted as a leading end, and the end on the −Y direction side that is opposite to the leading end is denoted as a base end, the attachment body 50 includes the connection structure 51 in the leading end portion. The connection structure 51 includes a first connection structure 51F and a second connection structure 51S respectively on both sides of the liquid outlet port 52 in the width direction.

The first connection structure 51F includes a container-side electric connector 53, which is a terminal unit that comes into electrical contact with the device-side electric connector 40. The container-side electric connector 53 is arranged vertically above the liquid outlet port 52. The container-side electric connector 53 is provided on a surface of a circuit board, for example, and the circuit board includes a memory that stores various types of information regarding the liquid container 20 (type of the liquid container 20, contained amount of liquid, and the like, for example).

The container-side electric connector 53 is arranged so as to face obliquely upward inside a terminal arrangement portion 53*a* that is provided in a mode of a recess that opens upward and in the attachment direction. Also, guide recesses 53*g* that extend in the attachment direction are provided on both side of the container-side electric connector 53 in the width direction.

The second connection structure 51S preferably includes an identification portion 54 for preventing erroneous insertion that is arranged vertically above the liquid outlet port 52. The identification portion 54 includes an unevenness having a shape that fits together with the block 44 (refer to FIG. 3) of the corresponding connection mechanism 29.

The connection structure 51 includes a pair of receiving portions 55 and 56. The pair of receiving portions 55 and 56 are provided as holes that open in the Y direction. The pair of receiving portions 55 and 56 are arranged side by side in the width direction so as to sandwich the liquid outlet port 52. The first receiving portion 55 is included in the first connection structure 51F, and the second receiving portion 56 is included in the second connection structure 51S. The first receiving portion 55 is configured as a substantially perfect circular hole, but the second receiving portion 56 is configured as a long hole having a substantially elliptical shape that is long in the width direction. The first receiving portion 55 receives insertion of the first positioning portion 45 (refer to FIG. 3) included in the connection mechanism 29. The second receiving portion 56 receives insertion of the second positioning portion 46 included in the connection mechanism 29.

The connection structure 51 further includes bias receiving portions 57 that receive a biasing force of the biasing portion 47*c* (refer to FIG. 3), and an insertion portion 58 provided below the liquid outlet port 52.

FIG. 5 is a schematic exploded perspective view that shows a state in which the liquid container 20 that constitutes the attachment body 50 is separated from the case 13. In the orientation of the attached state, the width of the liquid container 20 in the Z direction is smaller than the width in the Y direction and the width in the X direction. With this, the arrangement orientation of the liquid container 20 is stabilized in the case 13.

The case 13 includes a bottom plate 67 that constitutes a bottom face on which a liquid container 20 is mounted, side plates 68 that extend vertically upward from both ends of the bottom plate 67 in the width direction, a front plate 69 that extends vertically upward from a base end of the bottom plate 67, and a leading plate 70 that extends vertically upward from a leading end of the bottom plate 67.

In the case 13, the bottom plate 67, the side plates 68, the front plate 69, and the leading plate 70 constitute a main body that includes an accommodation space for accommodating the liquid container 20. The case 13 includes an opening 13*a* through which the liquid container 20 is inserted and removed to and from the accommodation space. In this embodiment, the opening 13*a* of the case 13 opens vertically upward.

The connection member 61 of the liquid container 20 is arranged on a leading end side inside the opening 13*a* of the case 13. A main body of the connection member 61 has a substantially rectangular parallelepiped shape. The width of the main body of the connection member 61 in the Z direction is smaller than the width in the X direction and the width in the Y direction. The liquid outlet port 52, the container-side electric connector 53, the terminal arrangement portion 53*a*, the guide recesses 53*g*, and the identification portion 54 are provided at the leading end of the connection member 61. A first hole 55*b* and a second hole 56*b* are further provided at the leading end of the connection member 61 so as to sandwich the liquid outlet port 52 in the width direction.

The leading end portion of the case 13 constitutes an engagement receiving portion 65 with which the connection member 61 of the liquid container 20 can engage. The engagement receiving portion 65 includes the bias receiving portions 57, and a notch 65*a* that is provided between the bias receiving portions 57 and engages with the insertion portion 58 provided in the connection member 61 of the liquid container 20. The engagement receiving portion 65 includes a first hole 55*a* and a second hole 56*a* that are respectively provided on both sides of the notch 65*a* in the width direction.

When the liquid container 20 is mounted in the case 13, the first hole 55*a* of the engagement receiving portion 65 aligns with the first hole 55*b* of the connection member 61 in the depth direction, and the second hole 56*a* of the engagement receiving portion 65 aligns with the second hole 56*b* of the connection member 61 in the depth direction. The first holes 55*a* and 55*b* constitute the first receiving portion 55, and the second holes 56*a* and 56*b* constitute the second receiving portion 56. The first hole 55*b* of the connection member 61 constitutes the first receiving portion 55 that receives the first positioning portion 45 in the attached state. The second hole 56*b* of the connection member 61 constitutes the second receiving portion 56 that receives the second positioning portion 46 in the attached state. Hereinafter, the first hole 55*b* is also referred to as a first receiving portion 55*b* provided in the connection member 61, and the second hole 56*b* is also referred to as a second receiving portion 56*b* provided in the connection member 61.

A plurality of guiding portions 73 each having a substantially columnar shape that protrude from the bottom plate 67 in a guiding direction are provided in the engagement receiving portion 65 of the case 13. The "guiding direction" is a direction in which the liquid container 20 is inserted/removed to/from the opening 13*a* of the case 13, and is a directing that intersects the bottom plate 67 and is along the side plates 68. In the first embodiment, the guiding direction is the Z direction that is orthogonal to the bottom plate 67. In this embodiment, two guiding portions 73 are formed side by side in the width direction.

A plurality of guided portions 72 are provided that are formed so as to pass through the connection member 61 of the liquid container 20 in the guiding direction. In this embodiment, two guided portions 72 are formed side by side in the width direction at positions on the −Y direction side relative to the liquid outlet port 52 and the container-side electric connector 53.

The guiding portions 73 provided in the case 13 guide the guided portions 72 provided in the connection member 61 in the guiding direction when the liquid container 20 is accommodated in the case 13. On the other hand, the guided portions 72 provided in the connection member 61 are guided in the guiding direction by the guiding portions 73 provided in the case 13.

In this embodiment, each guiding portion 73 has an approximately semicylindrically protruded shape, and the side face of the guiding portion 73 includes a planar restriction portion 73*a* located on the leading end side, and a curved face portion 73*b* on the base end side relative to the restriction portion 73*a*.

Also, each guided portion 72 is formed to have a shape that includes a restriction portion 72*a* and a curved face portion 72*b* so as to match the shape of the guiding portion 73. The restriction portions 72*a* and 73*a* restrict escape and rotation of the liquid container 20 when mounted in the case 13.

Furthermore, protrusions 75 having a dome shape, for example, in which at least the corner in the guiding direction is chamfered are formed on the leading end face of the connection member 61. Also, engagement holes 76 that engage with the protrusions 75 are formed in the leading plate 70 of the case 13. With such a configuration, when the liquid container 20 is mounted in the case 13, sense or tactile feeling indicating that engagement between the case 13 and the liquid container 20 is complete can be given to the user by click feeling. The protrusions 75 and the engagement holes 76 in this embodiment are formed on respective sides of the liquid outlet port 52 of the connection member 61 and the notch 65*a* of the case 13 in the width direction so as to form pairs.

The connection member 61 is provided with a handle 62. The handle 62 is constituted by a member that is different from the main body of the connection member 61, and can move relative to the connection member 61. Specifically, the handle 62 can move by rotating about a rotation shaft 63 provided in the connection member 61. The rotation shaft 63 is formed so as to open on both side in the width direction, and a bottomed semi-cylindrical portion protrudes from an upper face of the connection member 61.

The handle 62 includes a grip 62*a* that is gripped by a user. The grip 62*a* is located on the containing portion 60 side, in the depth direction, that is distant from the connection member 61 relative to the shaft 62*b* that is shaftsupported by the rotation shaft 63. Also, the handle 62 can pivot between a first orientation in which the grip 62*a* and the rotation shaft 63 are at the same height or the grip 62*a* is located below the rotation shaft 63 and a second orientation in which the grip 62*a* is located higher than the rotation shaft 63. The handle 62 may be omitted.

Figure 6:
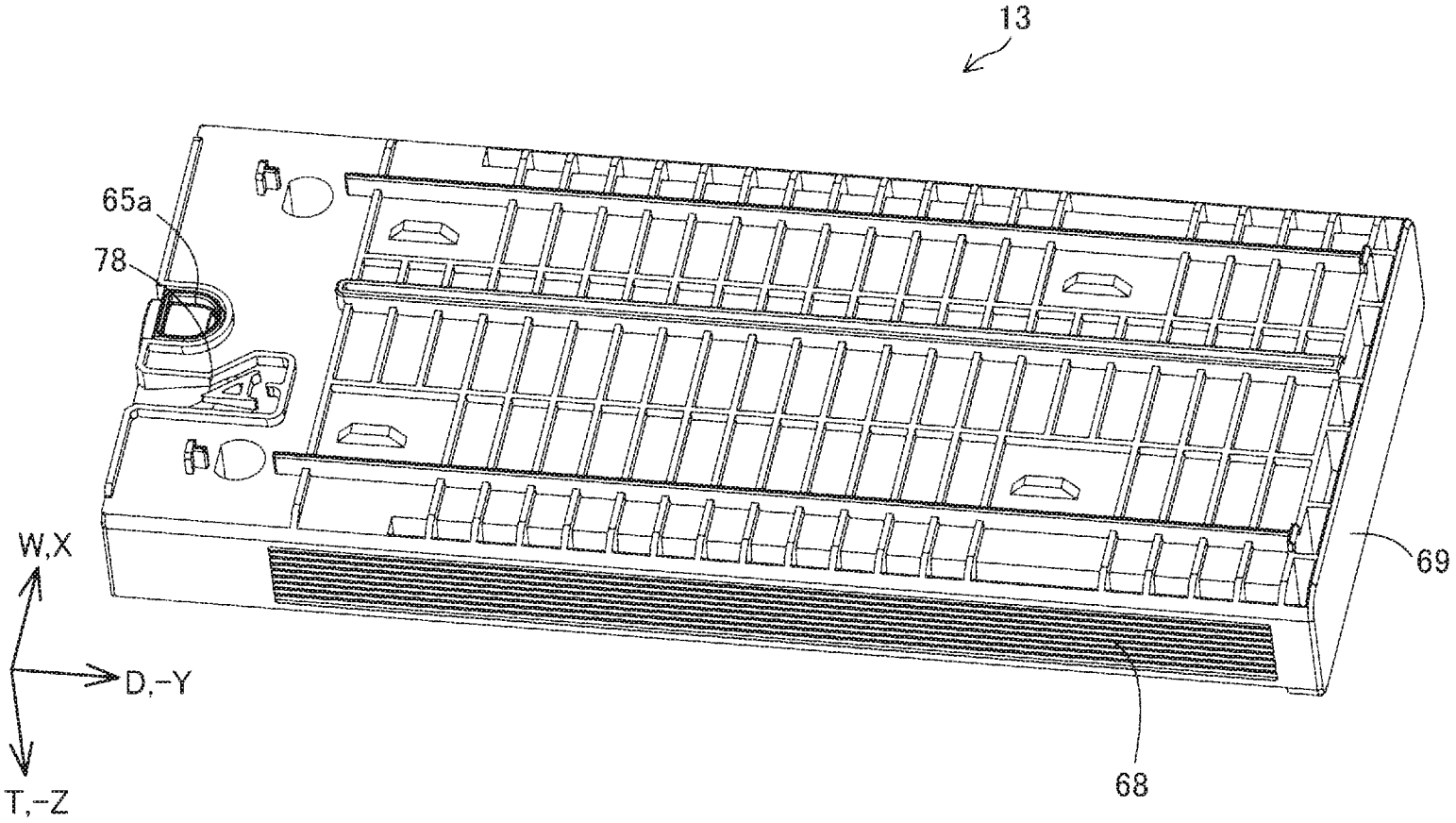
FIG. 6 is a schematic perspective view illustrating a back face side of a case.

FIG. 6 is a schematic perspective view showing a back face side of the case 13. The back face of the case 13 is a face on a side opposite to the face on which the liquid container 20 is arranged, and is a face that faces in the gravity direction in the attached state. An engagement groove 78 into which the locking portion 39 (refer to FIG. 3) of the device-side fixing structure 38 of the connection mechanism 29 is inserted and guided in the −Y direction is provided on the back face of the case 13 on the leading end side. The engagement groove 78 includes a known heart cam groove structure. The locking portion 39 engages with the engagement groove 78 in a state of applying a force in the −Z direction to the case 13, in the accommodated state in which the case 13 is accommodated in the case storage 14. With this, the movement of the case 13 in the accommodated state in the −Y direction is restricted. The engagement groove 78 is also referred to as a "case-side fixing structure 78".

The following is in reference to FIG. 5. The case-side fixing structure 78 opens in the +Y direction at the leading end of the case 13 in order to receive insertion of the device-side fixing structure 38. A hollow projection 79 that includes a portion of the case-side fixing structure 78 and protrudes in the +Z direction is provided at the end of the bottom plate 67 of the case 13 on the +Y direction side.

A recess 77 is provided at a lower end of the connection member 61, is depressed in the −Z direction in the attached state, and accommodates the projection 79. The recess 77 is located below the container-side electric connector 53. In the attached state, the projection 79 fits into the recess 77, and therefore the accuracy in positioning the container-side electric connector 53 in the case 13 is improved. Therefore, the electrical connectivity between the container-side electric connector 53 and the device-side electric connector 40 (refer to FIG. 3) of the connection mechanism 29 when the liquid container 20 is attached to the liquid ejection device 11 is improved.

Here, connection of the connection structure 51 included in the attachment body 50 to the connection mechanism 29 will be described with reference to FIGS. 3 and 4. When the attachment body 50 is inserted into the accommodation space and the leading end approaches the connection mechanism 29, first, the leading ends of the positioning portions 45 and 46 whose projection length in the removal direction is long respectively enter the receiving portions 55 and 56 of the attachment body 50 and engage therewith, and as a result, the movement of the attachment body 50 in the width direction is restricted. Since the second receiving portion 56 is an elliptical long hole that extends in the width direction, the positioning portion 45 that enters the circular first receiving portion 55 serves as the reference for positioning.

When the attachment body 50 advances in the depth direction after the positioning portions 45 and 46 respectively have engaged with the receiving portions 55 and 56, the bias receiving portion 57 comes into contact with the pressing portion 47*b* and the attachment body 50 receives a biasing force of the biasing portion 47*c*. Then, the device-side fixing structure 38 engages with the case-side fixing structure 78, and as a result, the movement of the case 13 in the −Y direction is restricted. Also, the liquid introduction member 32 is inserted, in the +Y direction, into the liquid outlet port 52 of the liquid container 20, and as a result, the liquid introduction member 32 is brought into communication with the inner space 60*c* of the containing portion 60 of the liquid container 20. It is preferable that the positioning of the attachment body 50 using the positioning portions 45 and 46 is performed before the liquid introduction member 32 is coupled to the liquid outlet port 52.

When the attachment body 50 is inserted to a correct position, the identification portion 54 properly fits with the block 44 of the connection mechanism 29. In contrast, when the attachment body 50 is attempted to be attached to a wrong position, because the identification portion 54 does not fit with the block 44, the attachment body 50 cannot move further in the depth direction, and therefore, erroneous attachment can be prevented.

Also, when the attachment body 50 advances in the attachment direction, the device-side electric connector 40 enters the inside of the terminal arrangement portion 53*a* of the attachment body 50, the position of the device-side electric connector 40 is adjusted by the guide recesses 53*g* respectively being guided to the guide projections 40*a*, and the device-side electric connector 40 comes into contact with the container-side electric connector 53. Since the container-side electric connector 53 is inclined so as to face the −Z direction, the container-side electric connector 53 comes into electrical contact with the device-side electric connector 40 while receiving a force including at least a component in the +Z direction from the device-side electric connector 40. With this, the container-side electric connector 53 is electrically coupled to the device-side electric connector 40, and information is transmitted and received between the circuit board and the control device 42.

As a result of the container-side electric connector 53 receiving a force including at least a component in the +Z direction from the device-side electric connector 40, a preferable electrical contact state between the container-side electric connector 53 and the device-side electric connector 40 is realized. In order to suppress positional shift between the container-side electric connector 53 and the device-side electric connector 40, it is preferable that the first receiving portion 55, which serves as a reference for positioning, is arranged in the first connection structure 51F, of the first connection structure 51F and the second connection structure 51S, that includes the container-side electric connector 53.

When the liquid outlet port 52 of the liquid container 20 is coupled to the liquid introduction member 32 to achieve a state in which liquid can be supplied, and the container-side electric connector 53 comes into contact with and electrically coupled to the device-side electric connector 40, the connection of the connection structure 51 to the connection mechanism 29 is complete. The attached state is a state in which this connection is complete.

Figure 7:
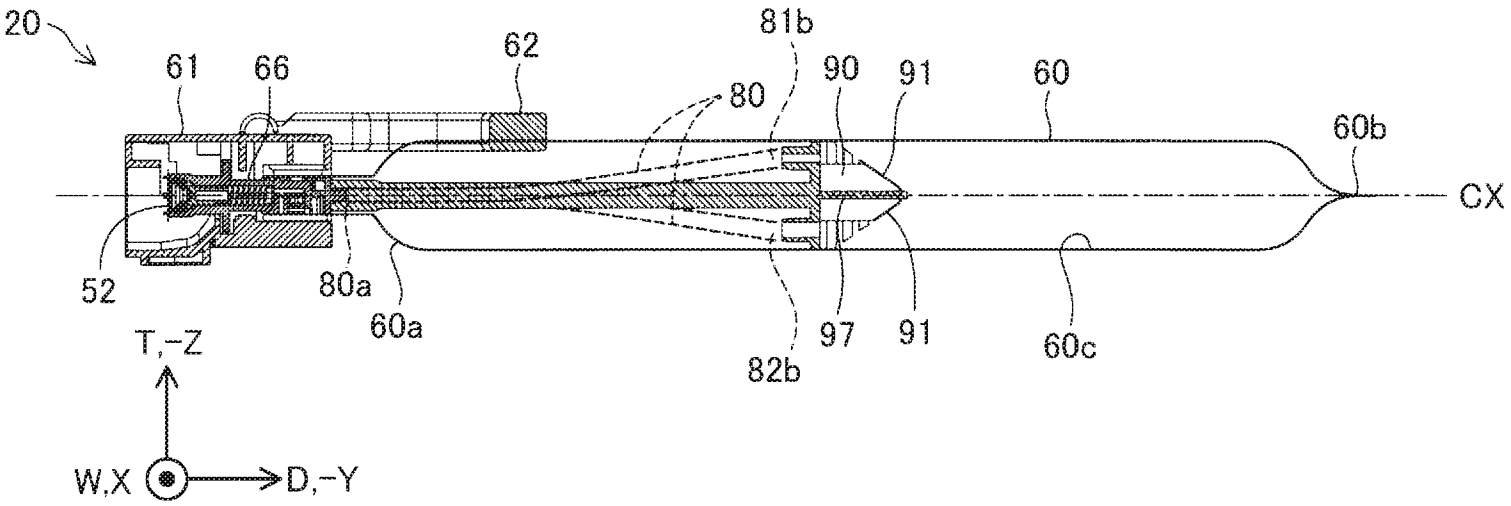
FIG. 7 is a schematic cross-sectional view of a liquid container.

FIG. 7 is a schematic cross-sectional view of the liquid container 20 taken along line 7-7 in FIG. 5. A central axis CX of the cylindrical liquid outlet port 52 is shown in FIG. 7. The liquid container 20 includes, inside the connection member 61, a liquid outlet member 66 that integrally includes the liquid outlet port 52 and is for guiding out liquid to be supplied to the liquid ejection device 11. The liquid outlet member 66 is attached to the one end portion 60*a*, which is an end portion of the containing portion 60 in the +Y direction side.

The liquid container 20 includes, inside the inner space 60*c* of the containing portion 60, liquid outlet tubes 80 and a spacer member 90. The liquid outlet tubes 80 are elastic tubes formed by elastomer, for example. The liquid outlet tubes 80 each include, inside the inner space 60*c*, a base end

80*a* coupled to the liquid outlet member 66. The liquid outlet tubes 80 extend, inside the inner space 60*c*, from the liquid outlet member 66 toward the other end portion 60*b*. A channel for bringing the liquid outlet tubes 80 and the liquid outlet port 52 into communication is formed inside the liquid outlet member 66. The liquid outlet member 66 fixes the liquid outlet port 52, the containing portion 60, the liquid outlet tube 80, and the spacer member 90 to the connection member 61.

The spacer member 90 is a structure for defining a region having a certain volume in the containing portion 60. The spacer member 90 is made of a synthetic resin such as polyethylene or polypropylene. The spacer member 90 has a portion positioned on the +D direction side relative to the liquid outlet tubes 80. Also, the spacer member 90 is provided at a position intersecting the TD plane that passed through the central axis CX of the liquid outlet port 52. The TD plane refers to a plane including the T direction and the D direction. The spacer member 90 has, on the +D direction side, faces 91 inclined such that the dimension in the T direction of the spacer member 90 increases from the +D direction side toward the −D direction side. Hereinafter, the faces 91 are referred to as "inclined faces 91". In this embodiment, the spacer member 90 has inclined faces 91 respectively on the +T direction side and the −T direction side relative to the central axis CX. Therefore, the spacer member 90 has a pointed shape toward the +D direction side, when viewed from the W direction. Note that in this embodiment, a "face" includes not only a face constituted only by a flat face, but also a face on which a groove, a recessed portion or the like is formed, a face on which a protrusion or a projection is formed, and a virtual face surrounded by a frame. In other words, as long as the face can be grasped as being a "face" overall, a certain region occupied by the face may include a recession, a projection, and a through hole.

In an orientation in which the liquid container 20 is attached to the liquid ejection device 11, at least one of the lowermost portion and the uppermost portion of the spacer member 90 comes into contact with the internal face of the containing portion 60. In this embodiment, as shown in FIG. 7, both the lowermost portion and the uppermost portion of the spacer member 90 are in contact with the internal face of the containing portion 60. Hereinafter, the orientation in which the liquid container 20 is attached to the liquid ejection device 11 is referred to as an "attached orientation". In this embodiment, in the attached orientation, the center between the heights of the lowermost portion and the uppermost portion of the spacer member 90 is the same as the height of the central axis CX of the liquid outlet port 52.

Figure 8:
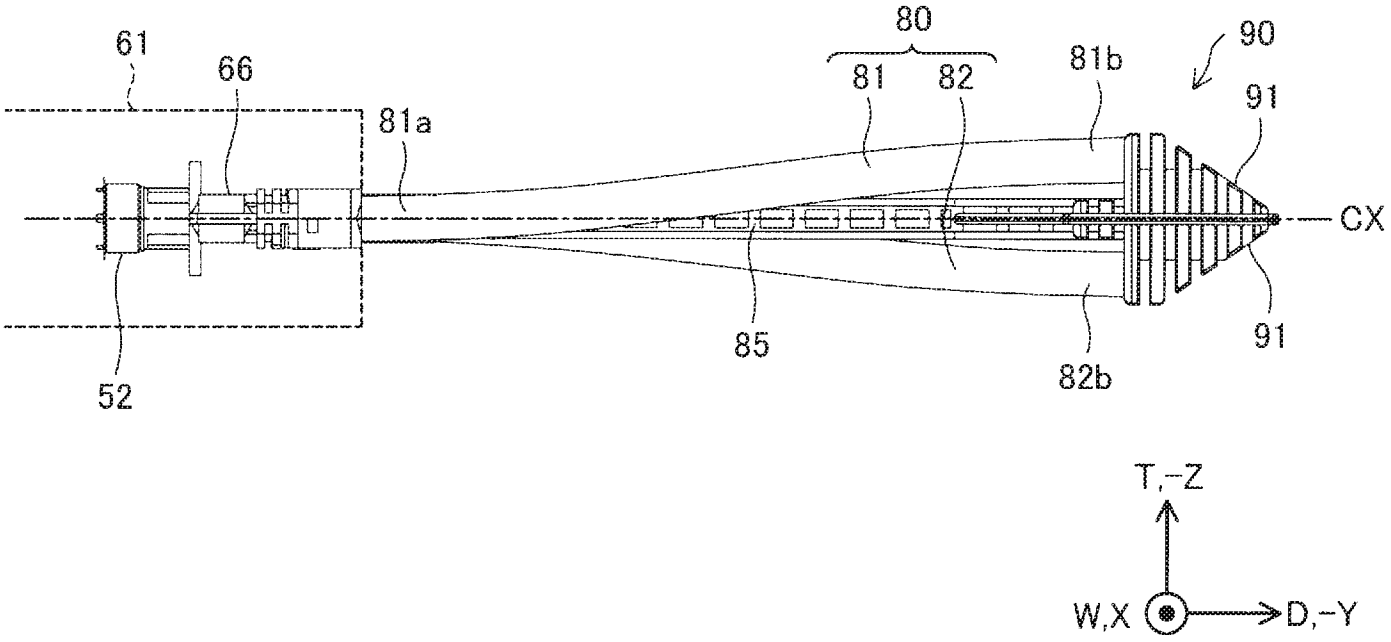
FIG. 8 is a schematic side view of a spacer member and a liquid outlet tube.
Figure 9:
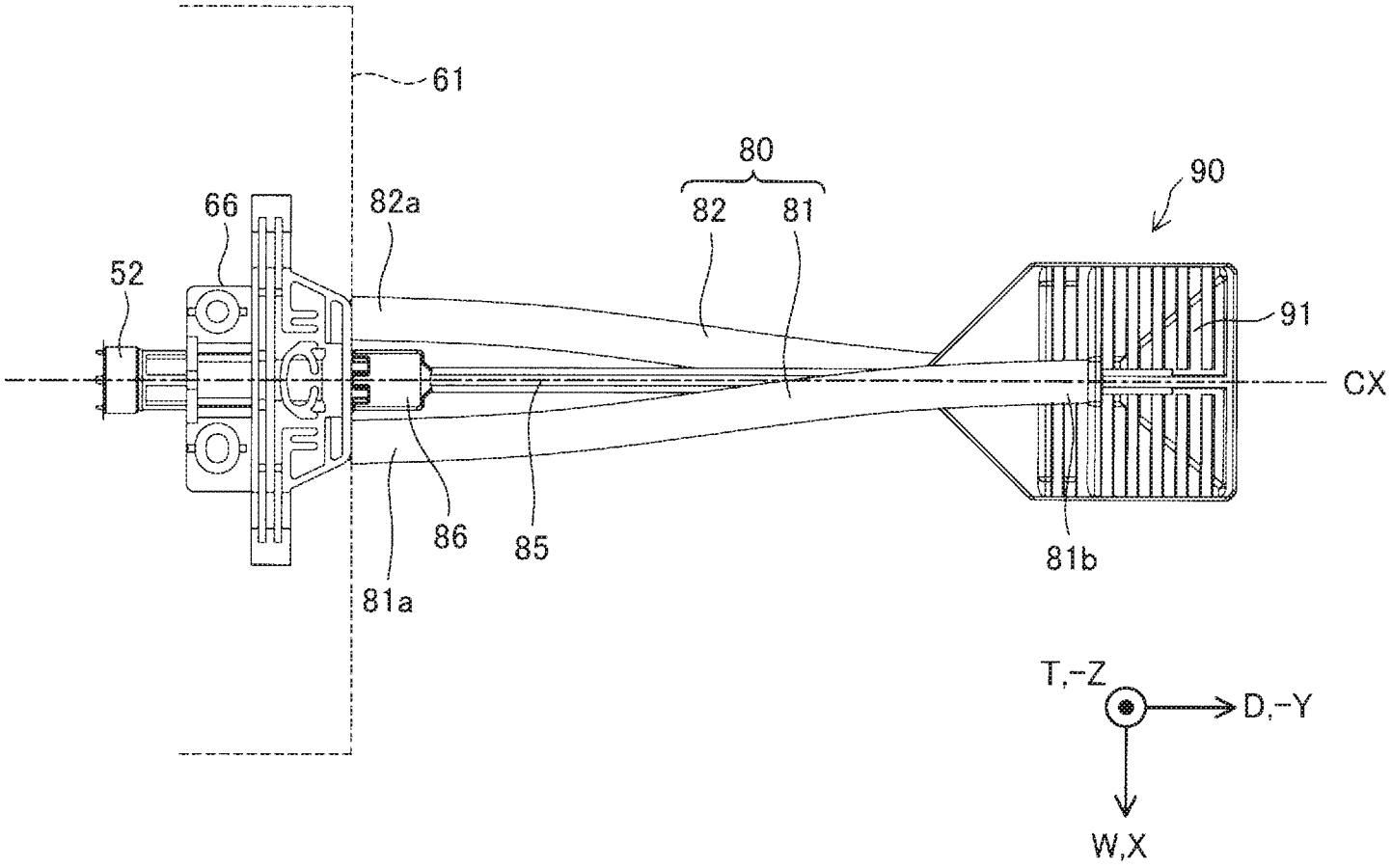
FIG. 9 is a schematic plan view of the spacer member and the liquid outlet tube.

FIG. 8 is a schematic side view of the spacer member 90 and the liquid outlet tubes 80. FIG. 9 is a schematic plan view of the spacer member 90 and the liquid outlet tubes 80. The liquid outlet tubes 80 are configured to extend in the horizontal direction in the inner space 60*c* (refer to FIG. 7) from the liquid outlet port 52 in the attached orientation. Also, in this embodiment, the spacer member 90 is fixed to the liquid outlet member 66 by a bar-like coupling member 85. In this embodiment, the coupling member 85 is integrally coupled to the spacer member 90. A locking portion 86 that is locked and fixed to a claw portion 59 (illustrated in later-referred FIG. 19) provided in a face of the liquid outlet member 66 on the +D direction side is provided at the end of the coupling member 85 on the −D direction side. Note that in other embodiments, the spacer member 90 may not be fixed to the liquid outlet member 66. For example, a structure may be adopted in which the spacer member 90 is fixed to the internal face of the bag 60.

In this embodiment, the liquid container 20 has a first channel portion 81 and a second channel portion 82 as the liquid outlet tubes 80. That is, the liquid container 20 includes two liquid outlet tubes 80. In this embodiment, the first channel portion 81 and the second channel portion 82 have the same length. The first channel portion 81 has a first base end 81*a* that is coupled to the liquid outlet member 66 and a first leading end 81*b* for introducing liquid in the inner space 60*c* into the first channel portion 81. The second channel portion 82 has a second base end 82*a* that is coupled to the liquid outlet member 66 and a second leading end 82*b* for introducing liquid in the inner space 60*c* into the second channel portion 82. Moreover, as shown in FIG. 7, in the attached orientation, the first leading end 81*b* is positioned above the second leading end 82*b*. As shown in FIG. 9, the above-described locking portion 86 is arranged so as to be sandwiched between the first base end 81*a* of the first channel portion 81 and the second base end 82*a* of the second channel portion 82 in the horizontal direction. Note that in other embodiments, the liquid container 20 may include three or more liquid outlet tubes 80.

As shown in FIGS. 8 and 9, in this embodiment, in the attached orientation, the first base end 81*a* of the first channel portion 81 and the second base end 82*a* of the second channel portion 82 are aligned in the horizontal direction, and the first leading end 81*b* of the first channel portion 81 and the second leading end 82*b* of the second channel portion 82 are aligned in the vertical direction. Therefore, liquid suctioned to the first channel portion 81 and liquid suctioned to the second channel portion 82 are converted from a state of flowing side by side in the vertical direction into a state of flowing side by side in the horizontal direction, are then mixed in the liquid outlet member 66, and are led out from the liquid outlet portion 52 to the liquid ejection device 11. Note that in other embodiments, it is possible to adopt a mode in which the first base end 81*a* and the second base end 82*a* are aligned in the vertical direction, and the first leading end 81*b* and the second leading end 82*b* are aligned in the horizontal direction, a mode in which the first base end 81*a* and the second base end 82*a* are aligned in the vertical direction, and the first leading end 81*b* and the second leading end 82*b* are also aligned in the vertical direction, and a mode in which the first base end 81*a* and the second base end 82*a* are aligned in the horizontal direction, and the first leading end 81*b* and the second leading end 82*b* are also aligned in the horizontal direction.

Figure 10:
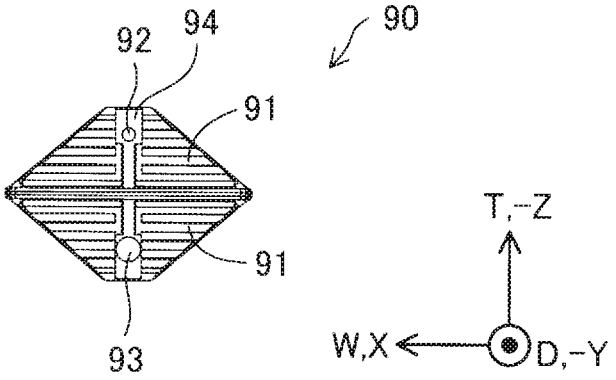
FIG. 10 is a schematic front view of the spacer member.
Figure 11:
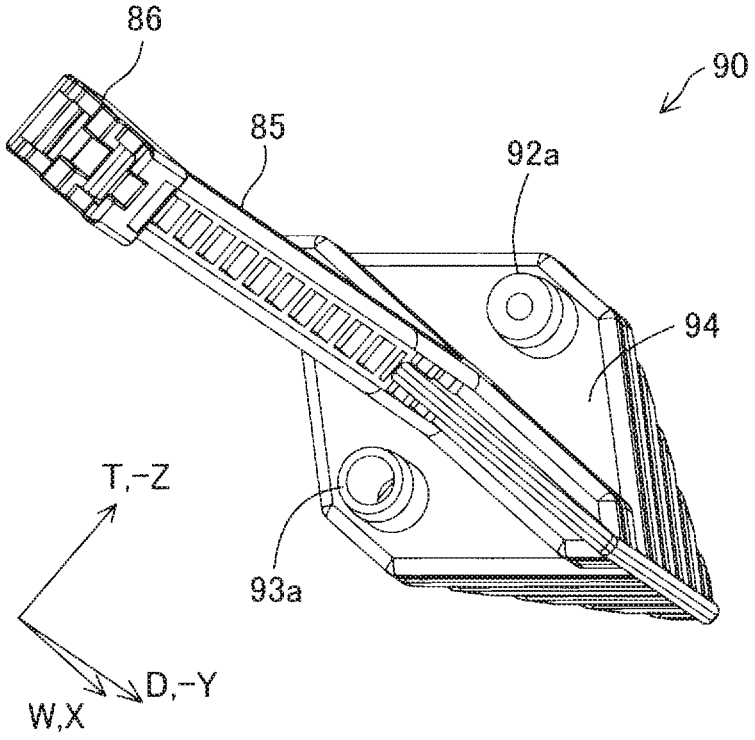
FIG. 11 is a schematic perspective view of a rear face side of the spacer member.

FIG. 10 is a schematic front view of the spacer member 90. FIG. 11 is a schematic perspective view of a rear face side of the spacer member 90. The spacer member 90 includes a first introduction port 92 and a second introduction port 93. The first introduction port 92 is an opening for introducing liquid on a relatively upper side of the inner space 60*c* of the containing portion 60 to the inside of the first channel portion 81. The second introduction port 93 is an opening for introducing liquid on a relatively lower side of the inner space 60*c* of the containing portion 60 to the inside of the second channel portion 82.

The spacer member 90 includes a rear face member 94 that is parallel to the TW plane at a position at which the dimension of the spacer member 90 in the T direction is largest. The rear face member 94 has an approximately hexagonal shape whose upper and bottom sides extends horizontally. The first introduction port 92 and the second introduction port 93 are provided in this rear face member 94. In this embodiment, the inner diameter of the first introduction port 92 is smaller than the inner diameter of the second introduction port 93. That is, the inner diameter of the second introduction port 93 is larger than the inner diameter of the first introduction port 92. Therefore, the second introduction port 93 positioned below the first introduction port 92 suctions liquid in the containing portion 60 more easily. Note that as shown in FIG. 10, in this embodiment, the spacer member 90 has an inclined face not only on the +D direction side but also on the +W direction side and the −W direction side.

The first introduction port 92 and the second introduction port 93 faces in the +D direction. Also, the first introduction port 92 and the second introduction port 93 are provided at positions that are symmetrical in the T direction relative to the central axis CX of the liquid outlet port 52 shown in FIG. 7. The first introduction port 92 is provided above the central axis CX, and the second introduction port 93 is provided below the central axis CX.

Figure 12:
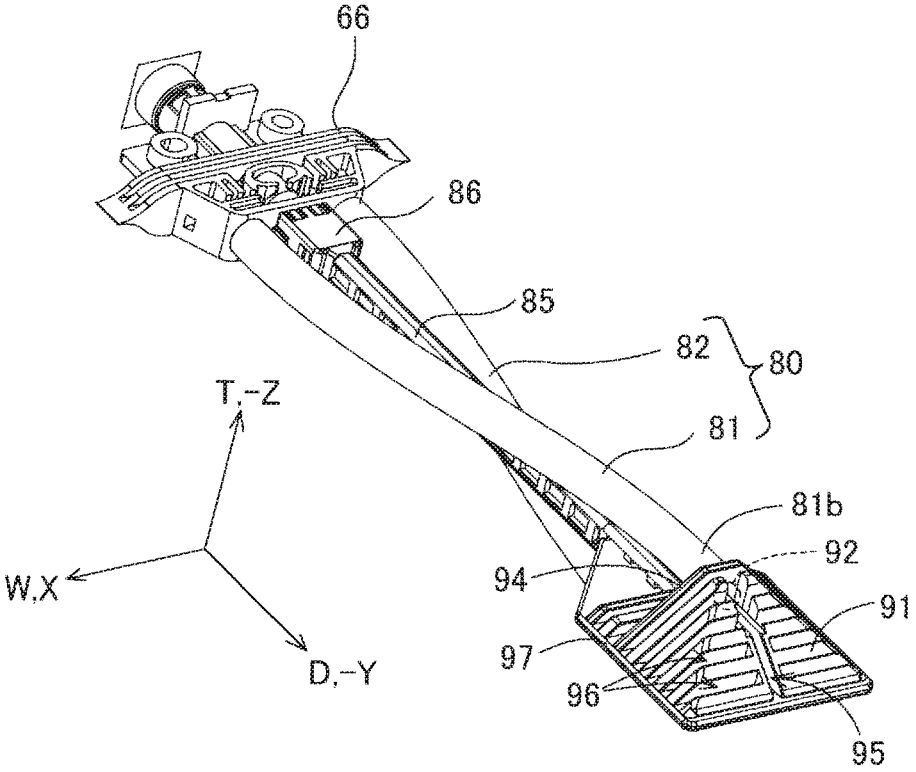
FIG. 12 is a first schematic perspective view of the spacer member and the liquid outlet tube.

FIG. 12 is a first schematic perspective view of the spacer member 90 and the liquid outlet tubes 80. The first leading end 81*b* of the first channel portion 81 of the liquid outlet tube 80 is coupled to the first introduction port 92. Specifically, a tube-shaped first connection port 92*a* that is to be in communication with the first introduction port 92 is provided in a face of the rear face member 94 (refer to FIG. 11) on the −D direction side, and the first connection port 92*a* is inserted into the first leading end 81*b* of the first channel portion 81, and as a result, the first leading end 81*b* of the first channel portion 81 is coupled to the first introduction port 92.

Figure 13:
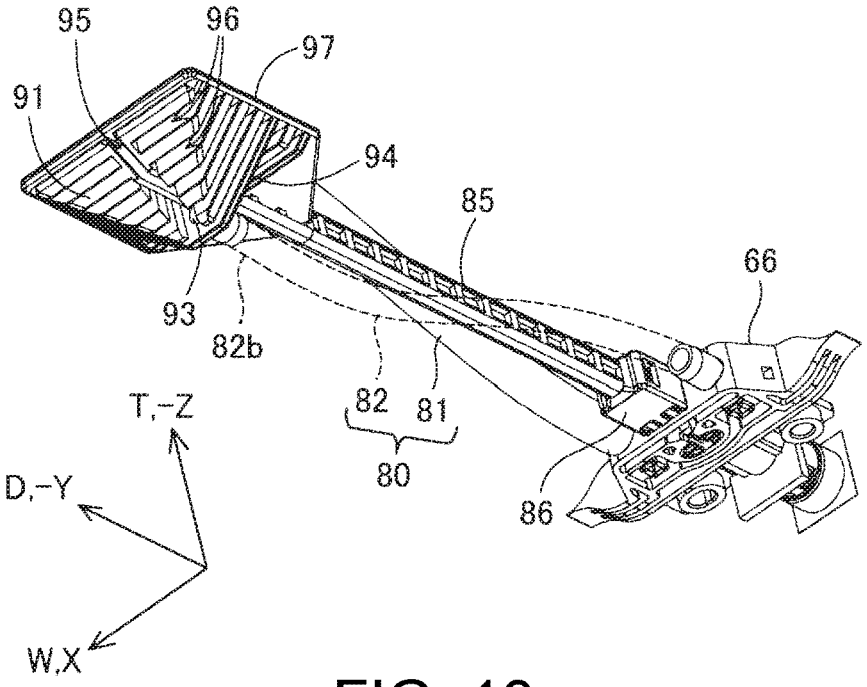
FIG. 13 is a second schematic perspective view of the spacer member and the liquid outlet tube.

FIG. 13 is a second schematic perspective view of the spacer member 90 and the liquid outlet tubes 80. The second leading end 82*b* of the second channel portion 82 of the liquid outlet tubes 80 is coupled to the second introduction port 93. Specifically, a tube-shaped second connection port 93*a* that is to be in communication with the second introduction port 93 is provided on the face of the rear face member 94 (refer to FIG. 11) on the −D direction side, and the second connection port 93*a* is inserted into the second leading end 82*b* of the second channel portion 82, and as a result, the second leading end 82*b* of the second channel portion 82 is coupled to the second introduction port 93. In this embodiment, the lengths of the second connection port 93*a* and the first connection port 92*a* in the D direction are the same.

As shown in FIGS. 12 and 13, in this embodiment, the first leading end 81*b* of the first channel portion 81 and the second leading end 82*b* of the second channel portion 82 are fixed to the spacer member 90. In contrast, in other embodiments, at least one of the first leading end 81*b* of the first channel portion 81 and the second leading end 82*b* of the second channel portion 82 may be separated from the spacer member 90. In this case, the first leading end 81*b* or the second leading end 82*b* that is separated from the spacer member 90 may directly introduce liquid, without the spacer member 90 being interposed therebetween.

As shown in FIGS. 12 and 13, the spacer member 90 is provided with a groove-shaped first channel 95 and second channels 96. The first channel 95 is a channel for allowing liquid to flow from the +D direction side to the first introduction port 92 and the second introduction port 93 located in the −D direction. The second channels 96 are channels for allowing liquid to flow in a direction intersecting the D direction. In this embodiment, a plurality of second channels 96 are formed. The second channels 96 are constituted by forming grooves extending vertically from the inclined face 91 of the spacer member 90 along the W direction. Note that the second channels 96 may be formed so as to allow liquid to flow in a direction intersecting both the W direction and the D direction. Also, in other embodiments, at least one of the first channel 95 and the second channel 96 can be omitted.

In this embodiment, the spacer member 90 is provided with a plate-like partition 97 that extends along a DW plane, which is the horizontal plane. The partition 97 is provided at a position between the first leading end 81*b* and the second leading end 82*b*, namely, a position between the first introduction port 92 and the second introduction port 93 in the T direction. In this embodiment, the central axis CX of the liquid outlet port 52 passes through the partition 97 (refer to FIG. 7). In other words, in this embodiment, the partition 97 is provided horizontally at the center of the inner space 60*c*. It can also be said that the plurality of channels 96 are formed by providing a plurality of ribs on the partition 97. Note that in other embodiments, the partition 97 may be omitted.

Figure 14:
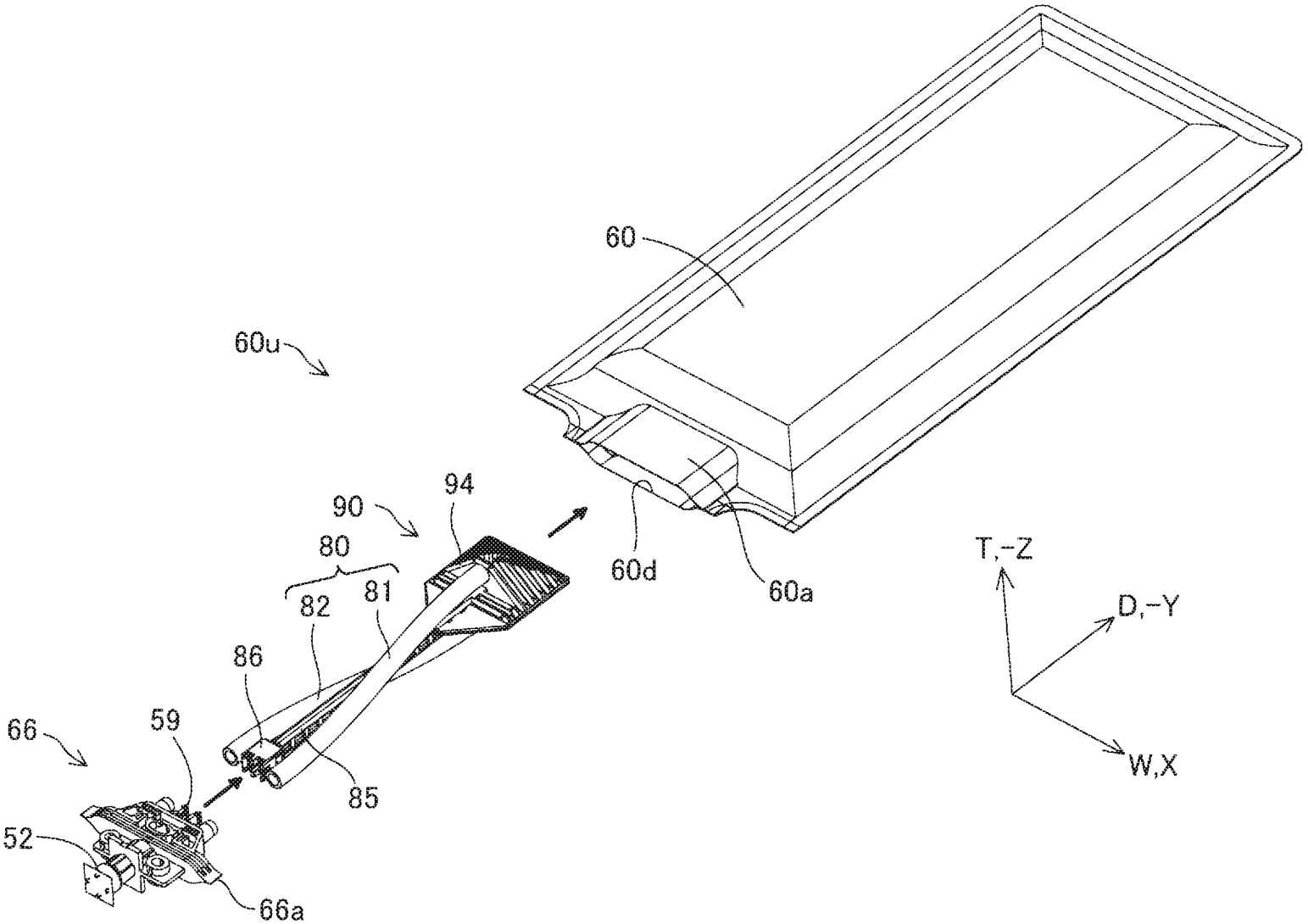
FIG. 14 is a first schematic exploded perspective view of a bag unit.
Figure 15:
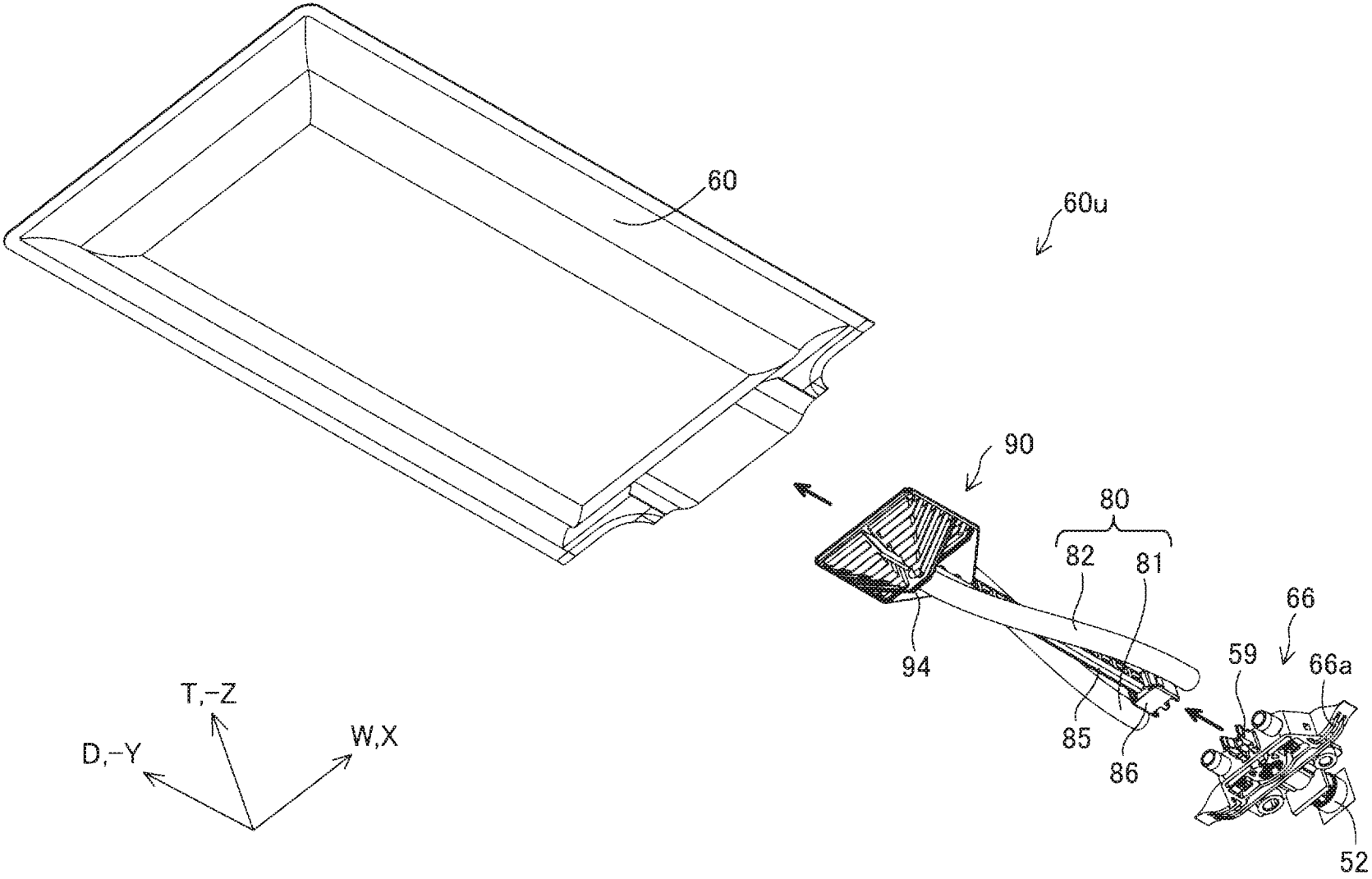
FIG. 15 is a second schematic exploded perspective view of the bag unit.

FIG. 14 is a first schematic exploded perspective view of the bag unit 60*u*. FIG. 15 is a second schematic exploded perspective view of the bag unit 60*u*. The containing portion 60 in which the spacer member 90 and the liquid outlet tubes 80 are inserted into the inside thereof and the liquid outlet member 66 is adhered to the one end portion 60*a* is referred to as a "bag unit 60*u*".

When the liquid container 20 is manufactured, first, the locking portion 86 provided in the coupling member 85 is coupled to the claw portion 59 provided in the liquid outlet member 66, and as a result, the spacer member 90 is fixed to the liquid outlet member 66. Then, the liquid outlet tubes 80 including the first channel portion 81 and the second channel portion 82 are coupled to the spacer member 90 and the liquid outlet member 66. The liquid outlet member 66 to which the spacer member 90 and the liquid outlet tubes 80 have been coupled is inserted, from the spacer member 90 side, into the inside of the containing portion 60 that is provided with an opening portion 60*d* on the one end portion 60*a* side through the opening portion 60*d*. After the spacer member 90 and the liquid outlet tubes 80 have been inserted into the containing portion 60, the opening portion 60*d* of the containing portion 60 is adhered to and joined to an adhesion portion 66*a* that is provided at the outer periphery of the liquid outlet member 66.

The adhesion portion 66*a* is a part at which the outer periphery of the liquid outlet member 66 is largest. The dimension of the inner periphery of the opening portion 60*d* is larger than or equal to the dimension of the outer periphery of the adhesion portion 66*a* of the liquid outlet member 66. Also, the dimension of the outer periphery of the adhesion portion 66*a* of the liquid outlet member 66 is larger than the dimension of the outer periphery of the rear face member 94 that has the largest outer periphery in the spacer member 90. Accordingly, in this embodiment, the spacer member 90 that is inserted into the bag 60 before the liquid outlet member 66 has a smaller outer periphery than the liquid outlet member 66, and thus the spacer member 90 can be easily inserted into the bag 60 when the liquid storage body 20 is manufactured. Therefore, it is possible to suppress damage due to the bag 60 excessively coming into contact with the spacer member 90 during manufacturing.

Figure 16:
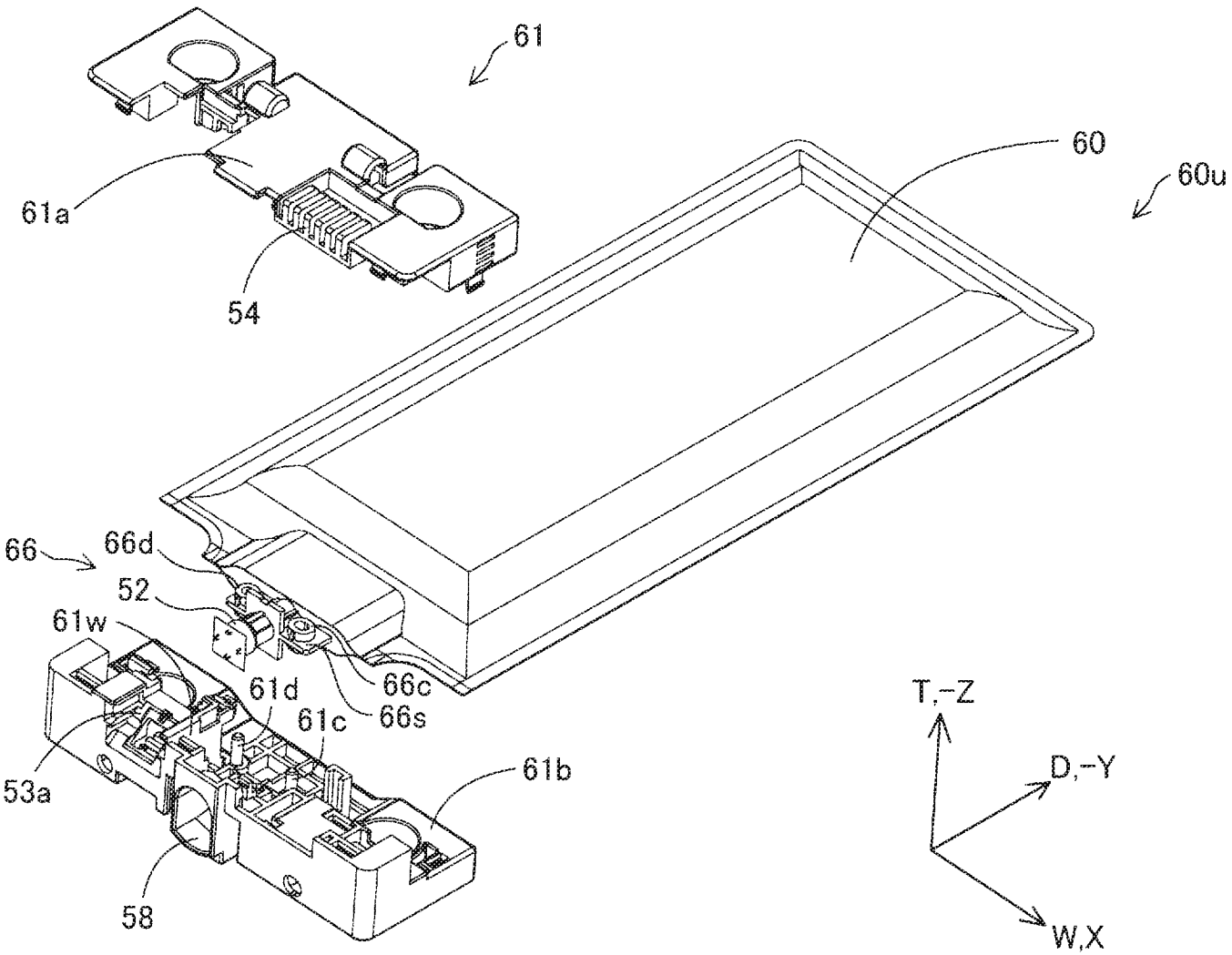
FIG. 16 is a schematic exploded perspective view of a connection member.

FIG. 16 is a schematic exploded perspective view of the connection member 61. The main body of the connection member 61 can be divided in the T direction, and includes a cover member 61*a* and a bottom member 61*b*. The bag unit 60*u* is fixed to the connection member 61 by sandwiching the end portion of the bag unit 60*u* on the −D direction side by the cover member 61*a* and the bottom member 61*b* from the +T direction side and the −T direction side.

The identification portion 54 is mainly formed in the cover member 61*a*. The above-described handle 62 (illustrated in FIGS. 4 and 5) is attached to the cover member 61*a*.

The insertion portion 58 and the terminal arrangement portion 53*a* are mainly formed in the bottom member 61*b*. In this embodiment, the bottom member 61*b* is provided with a first protrusion 61*c* and a second protrusion 61*d* that protrude in the +T direction. The first protrusion 61*c* and the second protrusion 61*d* are provided at positions that sandwich the insertion portion 58 in the W direction. A first through hole 66*c* and a second through hole 66*d* are provided in a fixing portion 66*s*, of the liquid outlet member 66, that is provided at a portion that exposes in the −D direction from the containing portion 60, at positions that sandwich the liquid outlet port 52. The first protrusion 61*c* is inserted into the first through hole 66*c*, and the second protrusion 61*d* is inserted into the second through hole 66*d*. A portion of the end portion of the containing portion 60 on the −D direction side is sandwiched between the cover member 61*a* and the bottom member 61*b* along with the fixing portion 66*s* of the liquid outlet member 66.

Figure 17:
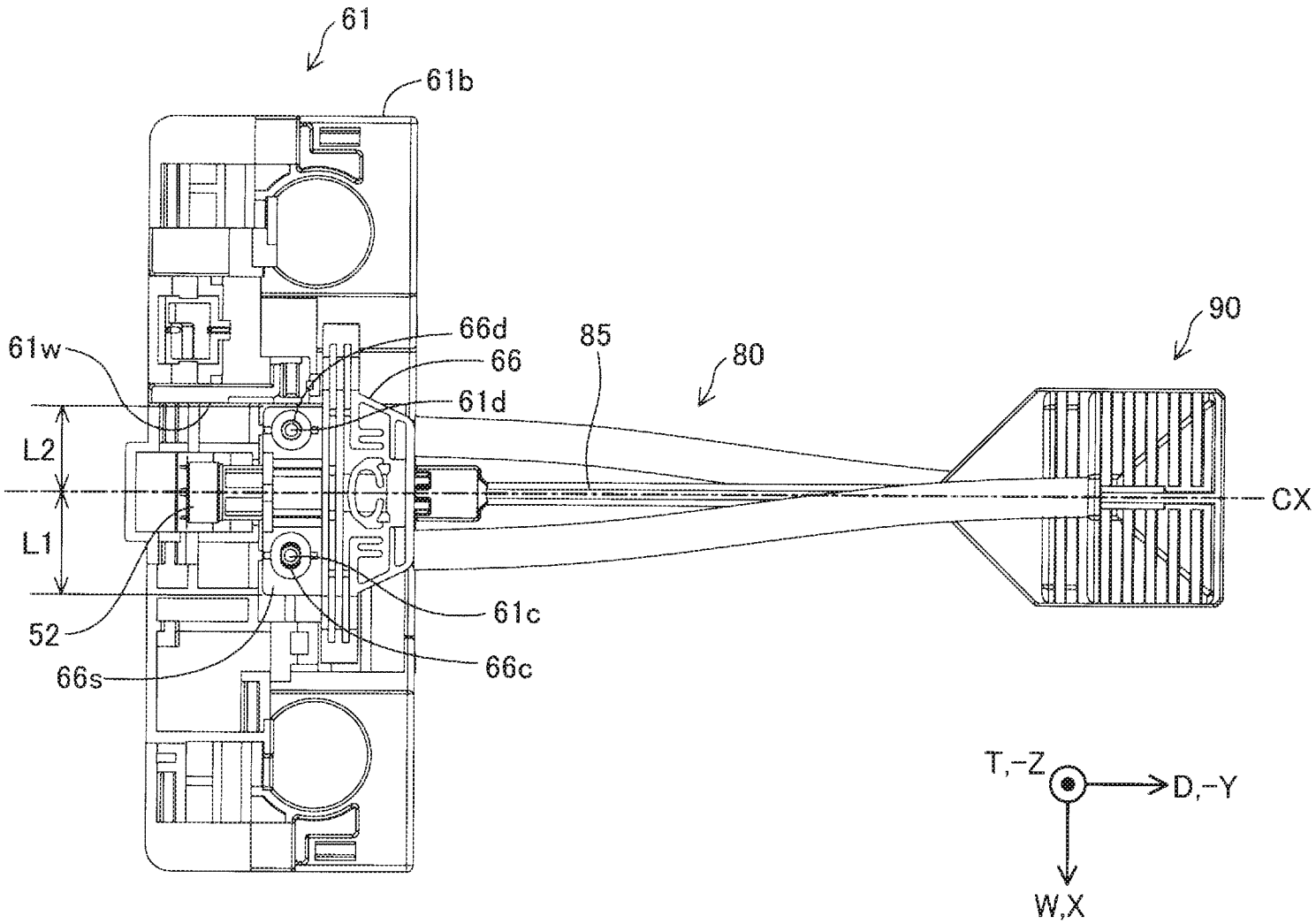
FIG. 17 is a schematic plan view illustrating a state in which a liquid outlet member is fixed to a bottom member.
Figure 18:
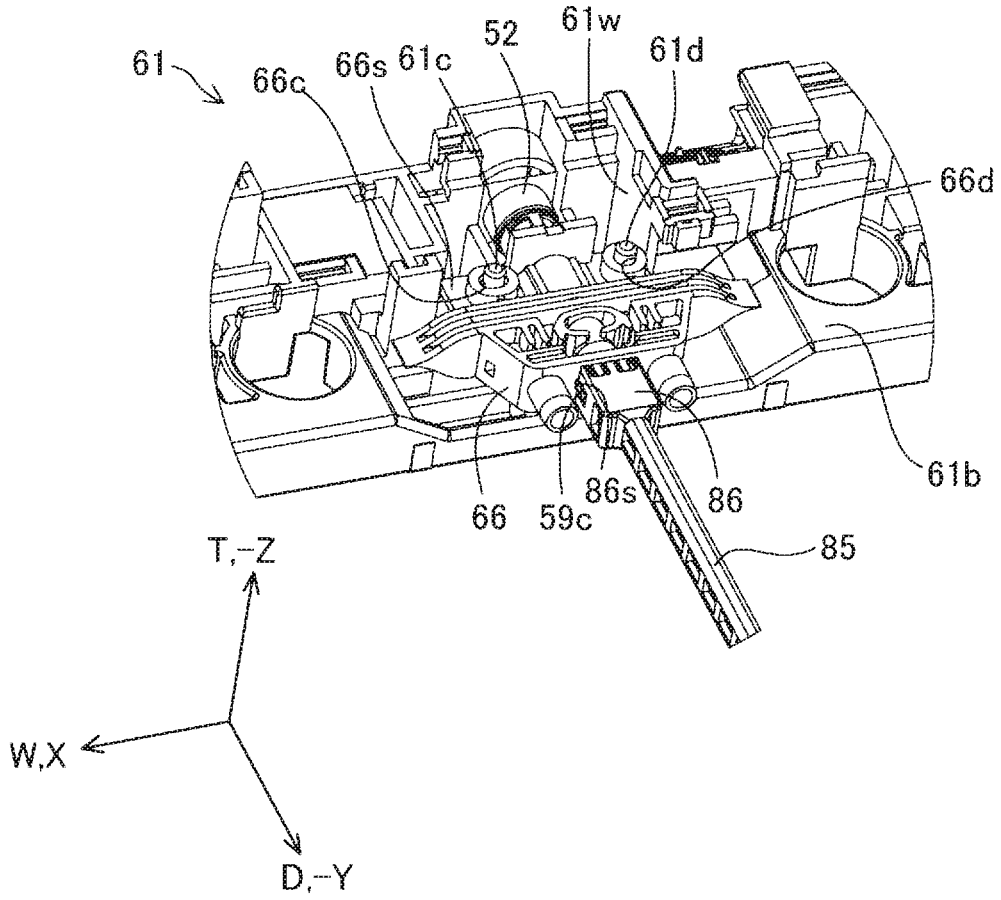
FIG. 18 is a schematic perspective view illustrating a state in which the liquid outlet member is fixed to the bottom member.

FIG. 17 is a schematic plan view illustrating a state in which the liquid outlet member 66 is fixed to the bottom member 61*b*. FIG. 18 is a schematic perspective view of a portion, of FIG. 17, in which the liquid outlet member 66 is fixed. The containing portion 60 is not illustrated in FIGS. 17 and 18.

As described above, the fixing portion 66*s* of the liquid outlet member 66 is provided with the first through hole 66*c* to which the first protrusion 61*c* is inserted and the second through hole 66*d* to which the second protrusion 61*d* is inserted respectively at positions that sandwich the liquid outlet port 52. The first through hole 66*c* and the second through hole 66*d* are provided at approximately the same distance in opposite directions from the central axis CX of the liquid outlet port 52, and are aligned in the W direction.

The fixing portion 66*s* has different dimensions from the central axis CX between that on the +W direction side and that on the −W direction side. Specifically, a length L2 from the central axis CX in the −W direction, which is on the second protrusion 61*d* side, is smaller than a length L1 in the +W direction, which is on the first protrusion 61*c* side (L2<L1). That is, the liquid outlet member 66 is formed to be asymmetrical relative to the central axis CX with respect to the −W direction side and the +W direction side. Also, a contact wall 61*w* is provided in the bottom member 61*b*, and is directed in the +T direction so as to be in contact with the end portion of the fixing portion 66*s* on the −W direction side, that is, on the smaller length side of the fixing portion 66*s*. In this embodiment, with such a structure, the liquid outlet member 66 is prevented from being mounted upside down to the bottom member 61*b*. Note that the first through hole 66*c* provided in the fixing portion 66*s* is preferably a substantially elliptic shaped elongated hole longer in the W direction in order to prevent the liquid outlet member 66 from being unable to be attached to the bottom member 61*b* due to a manufacturing error.

Figure 19:
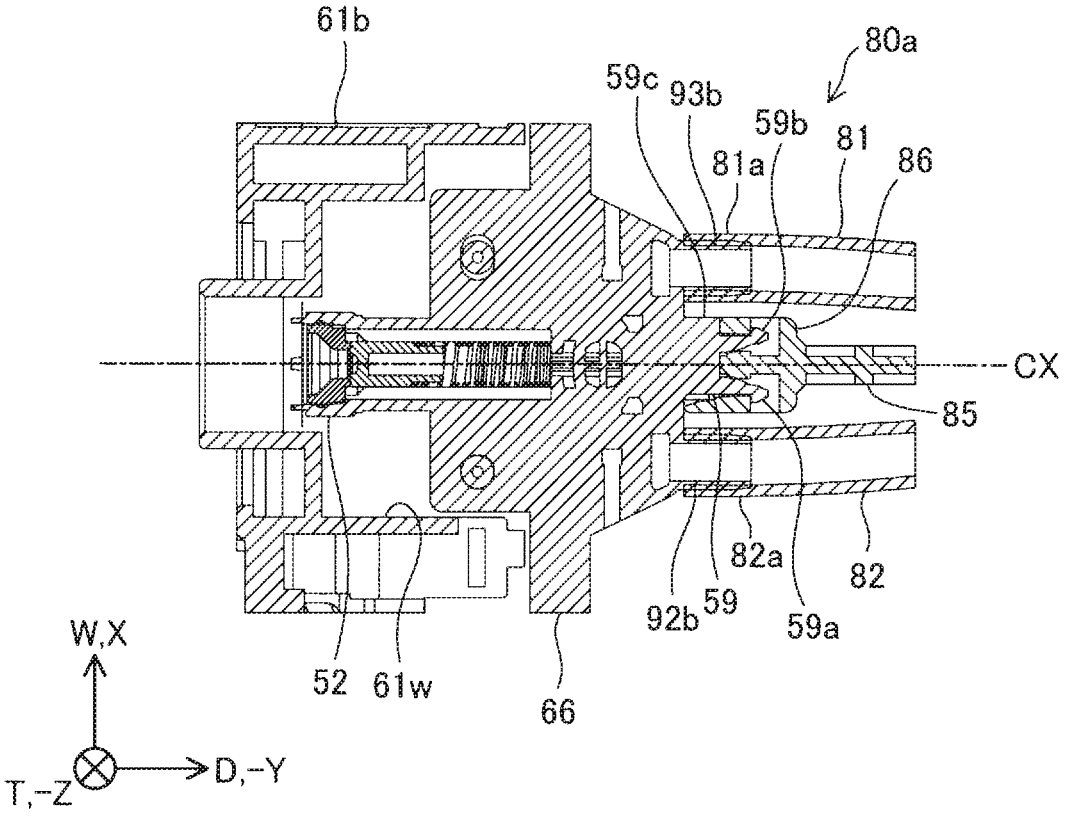
FIG. 19 is a schematic cross-sectional view illustrating a coupled part between the liquid outlet member and the liquid outlet tube and a coupling member.

FIG. 19 is a schematic cross-sectional view of a part at which the liquid outlet member 66, the liquid outlet tubes 80, and the coupling member 85 are coupled. The claw portion 59 of the liquid outlet member 66 is provided at an end of the liquid outlet member 66 on the −Y direction side. The claw portion 59 includes a first claw 59*a* and a second claw 59*b* that extend in the +D direction and are arranged side by side in the W direction. The first claw 59*a* is arranged on the −W side, and the second claw 59*b* is arranged on the +W side. The first claw 59*a* and the second claw 59*b* are provided, at the leading ends in the +D direction, with respective protrusions that face opposite directions and are to be fitted into openings provided in the side faces of the locking portion 86. The second claw 59*b* is provided with a rib 59*c*, at the base end on the +W direction side, that is directed from the −D direction side toward the +D direction side, as also shown in FIG. 18. The locking portion 86 is provided with a slit 86*s* at a position corresponding to the rib 59*c*. In this embodiment, with such a structure, the spacer member 90 coupled to the locking portion 86 is prevented from being coupled upside down to the liquid outlet member 66.

As shown in FIG. 19, the liquid outlet member 66 is provided with, at the end on the +D direction side, a third cylindrical connection port 92*b* and a fourth cylindrical connection port 93*b* that protrude in the +D direction and are to be arranged in the inner space 60*c* of the containing portion 60. The two connection ports 92*b* and 93*b* are arranged side by side in the W direction so as to sandwich the claw portion 59. In this embodiment, the distance from the central axis CX of the liquid outlet port 52 to the third connection port 92*b* and the distance from the central axis CX to the fourth connection port 93*b* are the same. The third connection port 92*b* and the fourth connection port 93*b* are in communication with the liquid outlet port 52, in the liquid outlet member 66. The third connection port 92*b* is inserted into the base end of the second channel portion 82, and the fourth connection port 93*b* is inserted into the base end of the first channel portion 81, and thus the liquid outlet tubes 80 (first channel portion 81 and second channel portion 82) are fixed to the liquid outlet member 66.

In this embodiment, the inner diameters of the first channel portion 81 and the second channel portion 82 are the same, and the outer diameters thereof are also the same. Furthermore, in this embodiment, the inner diameters of the third connection port 92*b* and the fourth connection port 93*b* are the same, and the outer diameters thereof are also the same. That is, in this embodiment, the ratio of the amount of liquid flowing into the first channel portion 81 to the amount of liquid flowing into the second channel portion 82 is determined based on the difference in the inner diameter between the first introduction port 92 and the second introduction port 93 provided in the spacer member 90. Therefore, members of the first channel portion 81 and the second channel portion 82 can be used in common. Also, members of the first channel portion 81 and the second channel portion 82 can be used in common, and thus it is possible to prevent the first channel portion 81 and the second channel portion 82 from being attached in an opposite manner. Note that in other embodiments, the inner diameters of the first channel portion 81 and the second channel portion 82 may be different, and the outer diameters thereof may also be different. In addition, the inner diameters of the third connection port 92*b* and the fourth connection port 93*b* may be different, and the outer diameters thereof may also be different.

(4) Manufacturing Method and Configuration of Liquid Supplier

Figure 20:
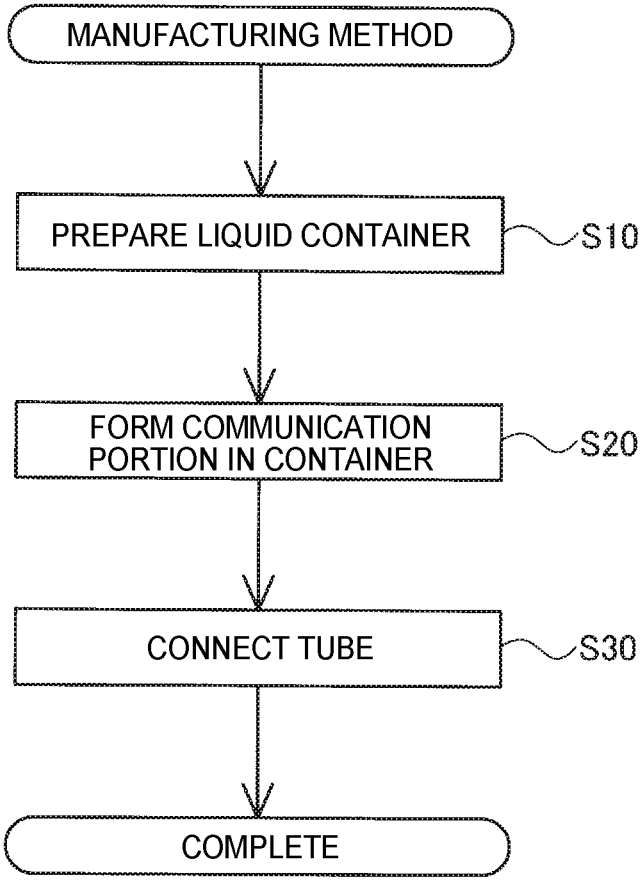
FIG. 20 is a flow diagram illustrating a manufacturing process of a liquid supplier of a first embodiment.

FIG. 20 is a flow diagram illustrating manufacturing process of the liquid supplier 210 illustrated in FIG. 22, which will be referred to later. The liquid supplier 210 is manufactured using the liquid container 20. As a result of attaching the liquid supplier 210, instead of the liquid container 20, to the liquid ejection device 11, the liquid to be consumed by the liquid ejector 21 of the liquid ejection device 11 can be supplied via the liquid supplier 210 from the outside of the liquid ejection device 11.

In step S10, a liquid container 20 is prepared. The liquid container 20 is desirably in a used state in which the amount of liquid contained in the containing portion 60 is less than or equal to a pre-determined lower limit amount. The "pre-determined lower limit amount" may be an amount that the control device 42 determines, by exchanging information with the container-side electric connector 53, that the liquid in the liquid container 20 is lacking, in a state in which the liquid container 20 is attached to the liquid ejection device 11, for example.

Figure 21A:
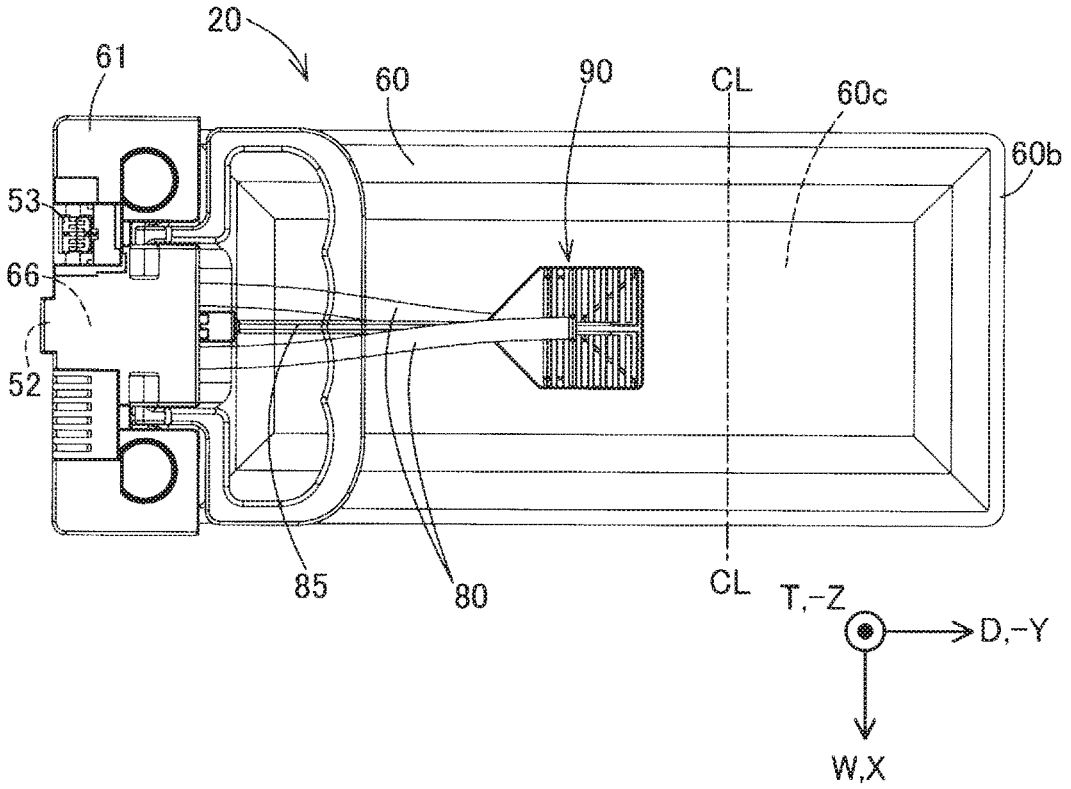
FIG. 21A is a first schematic diagram illustrating the manufacturing process of the liquid supplier in the first embodiment.
Figure 21B:
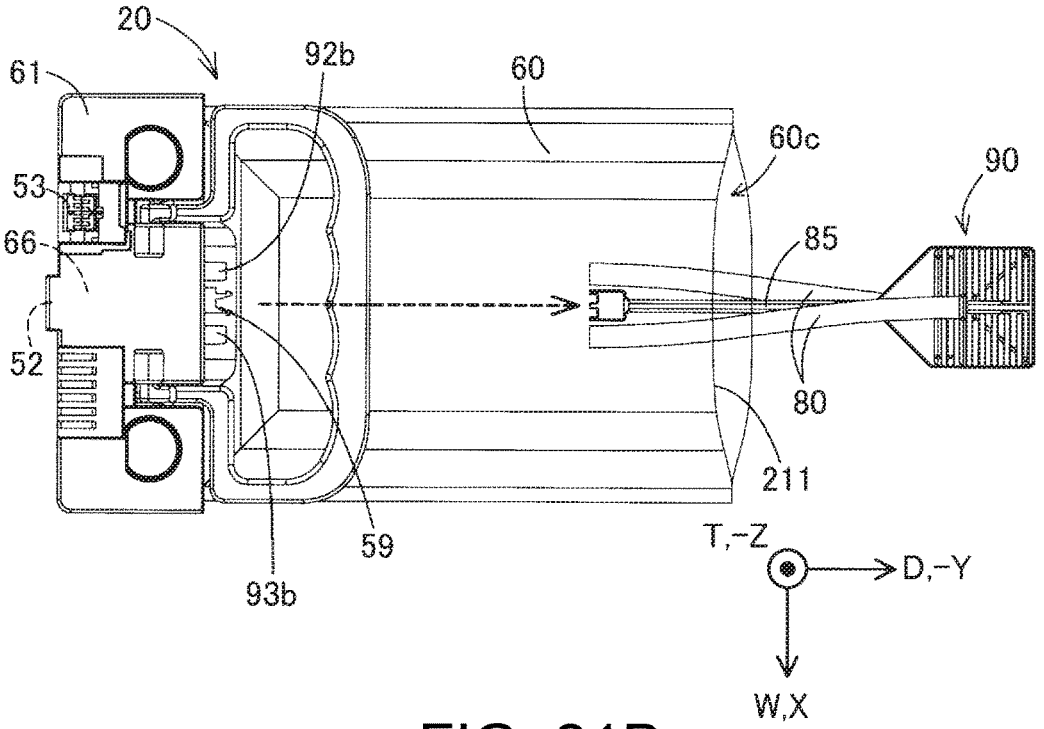
FIG. 21B is a second schematic diagram illustrating the manufacturing process of the liquid supplier in the first embodiment.
Figure 21C:
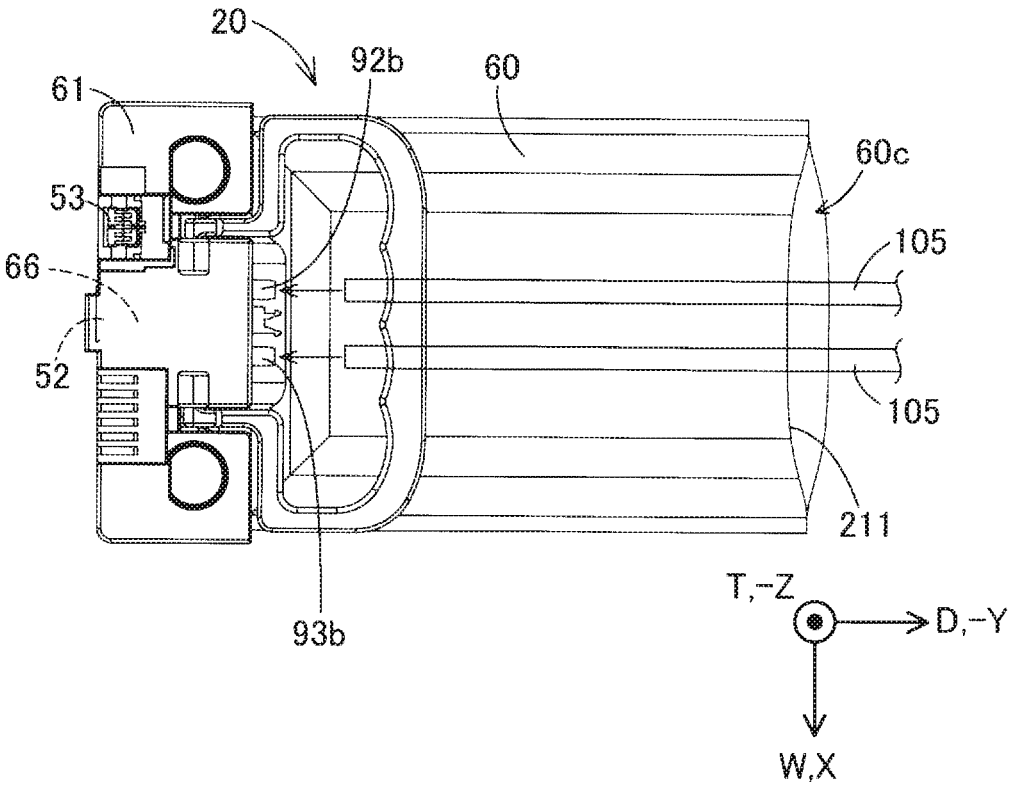
FIG. 21C is a third schematic diagram illustrating the manufacturing process of the liquid supplier in the first embodiment.

FIGS. 21A to 21C are schematic diagrams illustrating the processes in steps S20 to S30. In FIGS. 21A to 21C, the liquid container 20 is illustrated in a manner in which the inside of the containing portion 60 is visible, for the sake of convenience.

In step S20, a communication portion 211 (refer to FIG. 21B) that is in communication with the inner space 60*c* is formed in the containing portion 60 of the liquid container 20. The communication portion 211 is an opening portion formed in the containing portion 60 such that the structures such as the spacer member 90, the coupling member 85, and the liquid outlet tubes 80 that are accommodated in the inner space 60*c* can be accessed from the outside of the containing portion 60. In step S20, as a result of cutting off a portion of the containing portion 60 along a cutting-plane line CL, as illustrated in FIG. 21A, the communication portion 211 that opens in the −Y direction is formed, as illustrated in FIG. 21B, for example. The communication portion 211 is not limited to this configuration, and may be formed by providing a cut or a hole in the containing portion 60, or may be formed by breaking up adhesions at the end of the containing portion 60, for example.

In step S30, tubes 105 are coupled to the liquid outlet member 66. In step S30, first, as illustrated in FIG. 21B, the liquid outlet tubes 80 are removed from the third connection port 92*b* and the fourth connection port 93*b* of the liquid outlet member 66 that are provided at the end of the liquid outlet member 66 on the −Y direction side, and are in communication with the liquid outlet port 52 by working though the communication portion 211. Here, the coupling member 85 and the spacer member 90 may be removed from the liquid outlet member 66 and taken out from the containing portion 60 along with the liquid outlet tubes 80.

Next, as illustrated in FIG. 21C, the tubes 105 are inserted into the inner space 60*c* of the containing portion 60 through the communication portion 211, and are respectively coupled to the two connection ports 92*b* and 93*b* of the liquid outlet member 66. Note that in other embodiments, one of the two connection ports 92*b* and 93*b* may be sealed, and a tube 105 is only coupled to the other tube.

Figure 22:
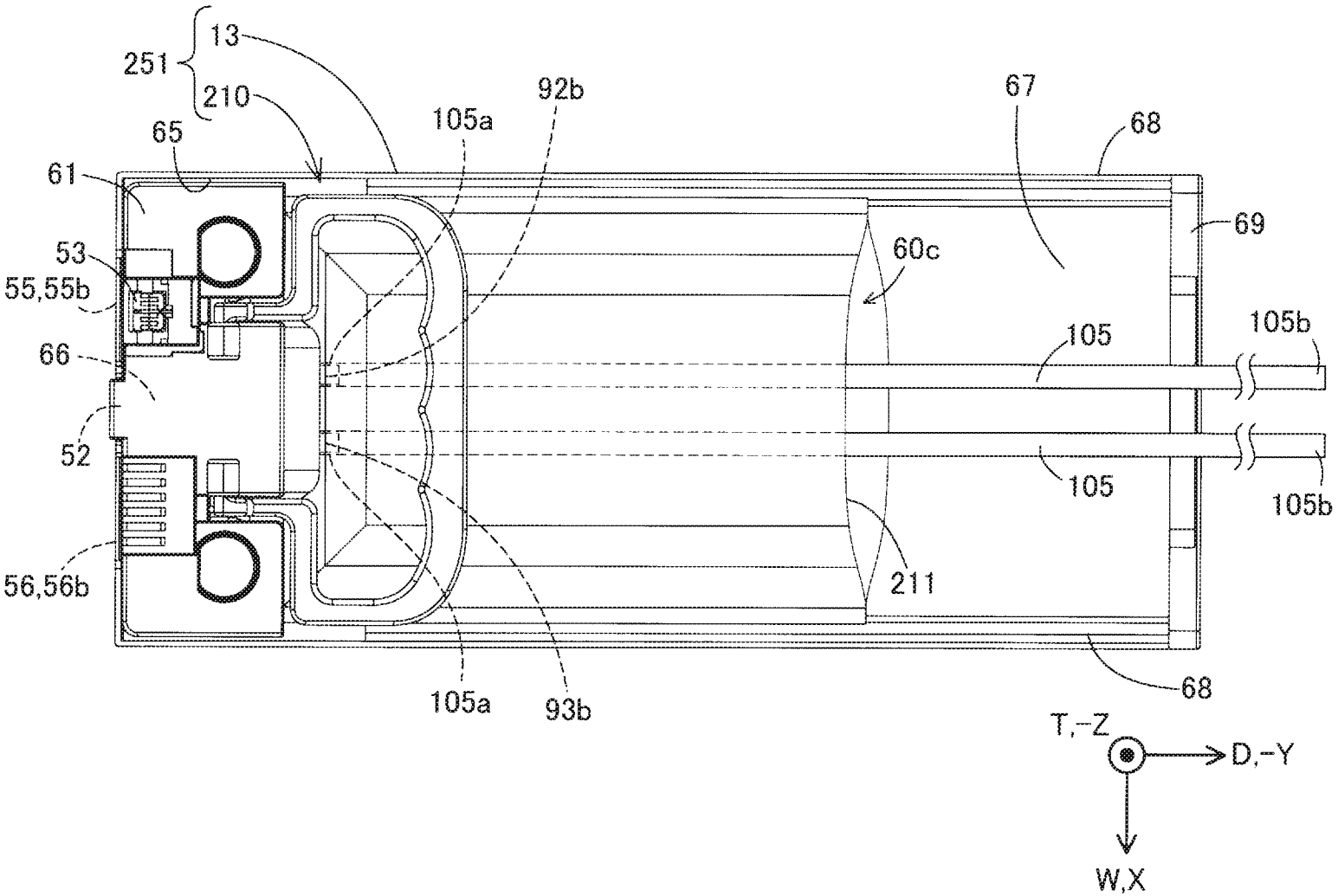
FIG. 22 is a schematic plan view illustrating the liquid supplier in the first embodiment.

FIG. 22 is a schematic plan view of an attachment body 251 in which the liquid supplier 210 manufactured through the above-described steps S10 to S30 is mounted in the case 13, when viewed in the +Z direction. The liquid supplier 210 includes the connection member 61, which is common to the liquid container 20, that is provided with the container-side electric connector 53, the first receiving portion 55*b*, the second receiving portion 56*b*, and the liquid outlet member 66 including the liquid outlet port 52.

The liquid supplier 210 can be attached to and detached from the case 13 that is the same as that to which the liquid container 20 is attached. The liquid supplier 210 is, similarly to the liquid container 20, attached to the liquid ejection device 11 in a state of being attached to the case 13 and constituting the attachment body 251. Hereinafter, the state in which the liquid supplier 210 is attached to the liquid ejection device 11 is referred to as an "attached state", similarly to the liquid container 20.

When the liquid supplier 210 is attached to the case 13, the connection member 61 engages with the engagement receiving portion 65 of the case 13. Since the liquid supplier 210 includes the connection member 61 that is common to the liquid container 20, the liquid supplier 210 can be easily coupled to the liquid ejection device 11, and failure in connecting with the liquid ejection device 11 can be suppressed, similarly to the liquid container 20.

In an orientation in the attached state when the attachment body 251 is attached to the liquid ejection device 11, the width of the liquid supplier 210 in the Z direction is smaller than the width in the Y direction and the width in the X direction. Here, the width of the liquid supplier 210 in the Y direction may be the dimension when the tubes 105 are excluded. As a result of the width in the Z direction being small in this way, the arrangement orientation of the liquid supplier 210 on the case 13 is stabilized.

In the liquid supplier 210, one ends 105*a* of the tubes 105 are respectively coupled to the connection ports 92*b* and 93*b* of the liquid outlet member 66. Also, the other ends 105*b* of the tubes 105 extend to the outside of the containing portion 60 from the communication portion 211, and extend to the outside of the case 13. The other ends 105*b* of the tubes 105 are arranged outside the liquid ejection device 11 in the attached state. Liquid that is to be supplied to the liquid ejection device 11 is injected into the tubes 105 from the other ends 105*b*.

(5) Configuration of Liquid Supply System

Figure 23:
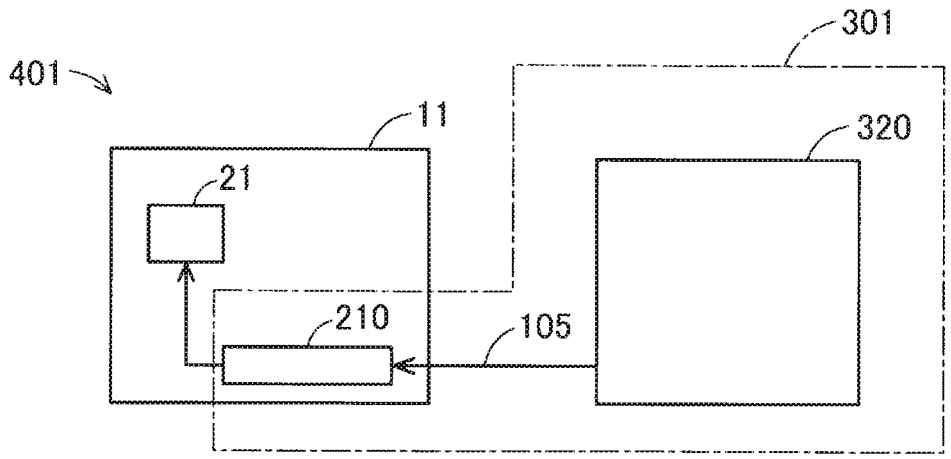
FIG. 23 is a schematic block diagram illustrating a liquid supply system in the first embodiment.

FIG. 23 is a schematic block diagram illustrating the liquid supply system 301 including the liquid supplier 210, and a liquid ejection system 401 including the liquid supply system 301. The liquid ejection system 401 includes the liquid ejection device 11 including the liquid ejector 21 that ejects liquid, and the liquid supply system 301 that supplies liquid to the liquid ejector 21.

The liquid supply system 301 includes the liquid supplier 210 and a tank 320 that contains liquid. The tank 320 is coupled to the tubes 105 of the liquid supplier 210. It is desirable that the tank 320 can contain larger amount of liquid than the containing portion 60 of the liquid container 20.

The liquid supplier 210 is accommodated, in the attached state of being attached to the case 13 illustrated in FIG. 22, in the case storage 14 of the liquid ejection device 11, and is coupled to the connection mechanism 29 of the liquid ejection device 11. The method of connecting the liquid supplier 210 to the connection mechanism 29 of the liquid ejection device 11 is similar to that of the liquid container 20. The liquid supply system 301 supplies liquid in the tank 320 to the liquid ejection device 11 to which the liquid supplier 210 is attached, via the tubes 105. The liquid in the tank 320 flows into the tubes 105 by suction driving performed in the liquid ejection device 11.

(6) Summary of First Embodiment

As described above, according to the liquid supplier 210 of the first embodiment, and the liquid supply system 301 including the liquid supplier 210, liquid can be supplied to the liquid ejection device 11 from the outside of the liquid ejection device 11 via the tubes 105. Therefore, liquid can be supplied to the liquid ejection device 11 continuously over a long period of time compared with the case where the liquid is supplied to the liquid ejection device 11 using the liquid container 20. Also, after the liquid supplier 210 is attached to the liquid ejection device 11, the time and effort involved in replacing the liquid container 20 and discarding a used liquid container 20 can be omitted, and therefore the operating cost of the liquid ejection device 11 can be reduced.

The liquid supplier 210 of the first embodiment can be manufactured at a low cost by performing a simple work on a liquid container 20 that is attached to the liquid ejection device 11, and is effectively manufactured. Also, since the liquid supplier 210 of the first embodiment uses the structure for connecting the liquid container 20 to the liquid ejection device 11 as is, the liquid supplier 210 can be easily coupled to the liquid ejection device 11, and the failure in connecting to the liquid ejection device 11 can be suppressed. In addition, the liquid supplier 210 can be coupled to the liquid ejection device 11 without modifying the structure of the liquid ejection device 11 such as the case 13 and the connection mechanism 29, and as a result, the liquid supplier 210 can be effectively realized.

In addition, according to the liquid supplier 210 of the first embodiment, the manufacturing method thereof, and the liquid supply system 301, various effects described in the first embodiment can be exhibited including the effects obtained by the fact that the liquid supplier 210 has a configuration that is in common with the liquid container 20.

2. Second Embodiment

Figure 24:
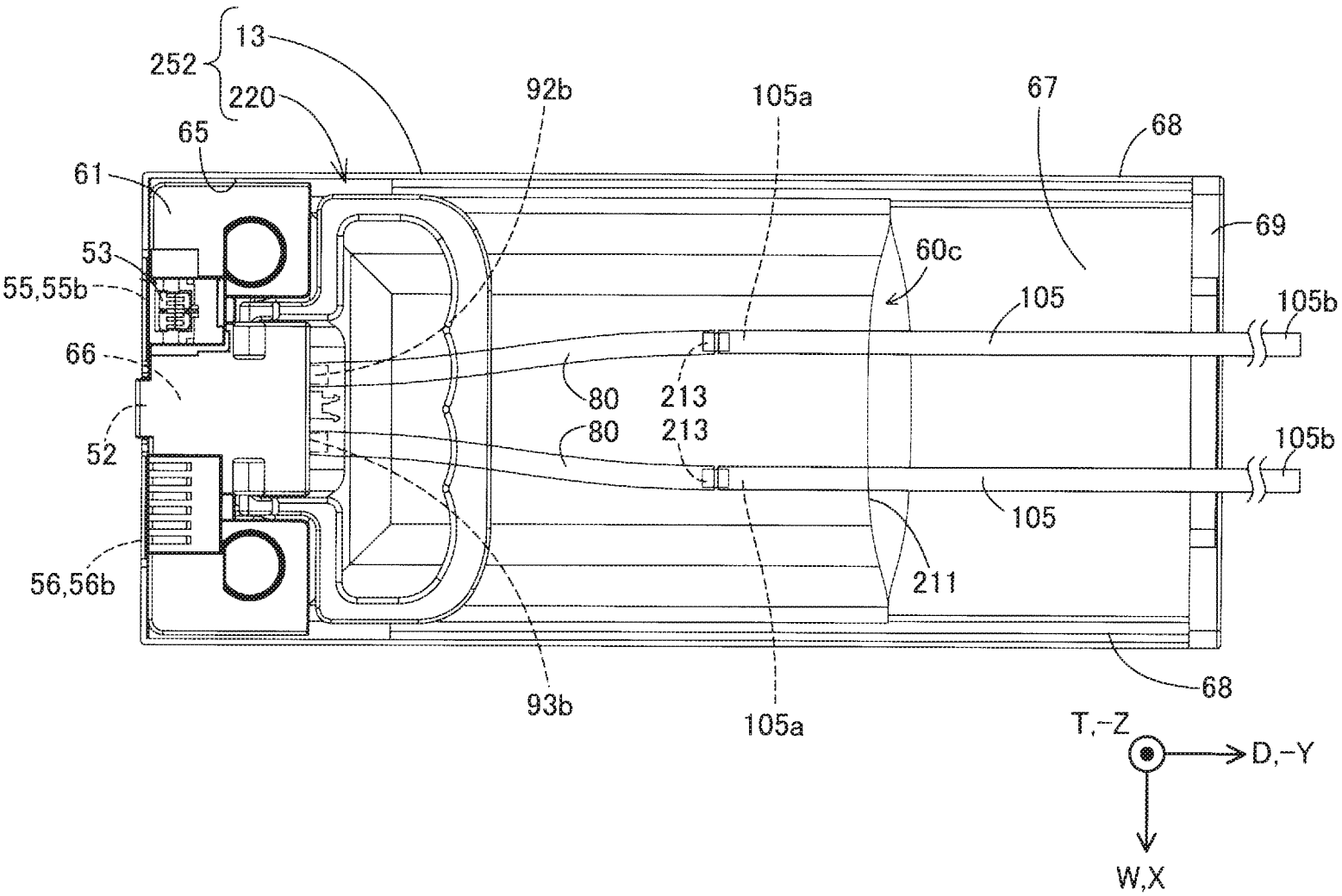
FIG. 24 is a schematic plan view illustrating a liquid supplier in a second embodiment.

FIG. 24 is a schematic plan view of an attachment body 252 in which a liquid supplier 220 of a second embodiment is mounted on the case 13, when viewed in the +Z direction. The configuration of the liquid supplier 220 of the second embodiment is almost the same as the configuration of the liquid supplier 210 of the first embodiment, except that the liquid outlet tubes 80 are not removed from the liquid outlet member 66, and the one ends 105*a* of the tubes 105 are coupled to the connection ports 92*b* and 93*b* via the liquid outlet tubes 80.

In the liquid supplier 220, the one ends 105*a* of the tubes 105 are respectively coupled to the liquid outlet tubes 80 via respective tube-shaped joint members 213 attached to the leading ends 81*b* and 82*b* of the liquid outlet tubes 80. The other ends 105*b* of the tubes 105 are arranged outside the liquid ejection device 11 in the attached state, similarly to the first embodiment. Note that, in the example in FIG. 24, the coupling member 85 and the spacer member 90 are removed from the liquid outlet member 66. A configuration may be adopted in which the coupling member 85 and the spacer member 90 remain coupled to the liquid outlet member 66.

The liquid supplier 220 can be manufactured using manufacturing process similar to that of the liquid supplier 210 described in the first embodiment, except that the liquid outlet tubes 80 are not removed from the liquid outlet member 66, and the tubes 105 are coupled to the respective liquid outlet tubes 80 (refer to FIG. 20). Also, as a result of the liquid supplier 220 being coupled to the tank 320 via the tubes 105, a liquid supply system, for supplying liquid to the liquid ejection device 11, that is similar to the liquid supply system 301 (refer to FIG. 23) of the first embodiment can be configured. According to the liquid supplier 220 of the second embodiment, the manufacturing method thereof, and the liquid supply system, various types of effects similar to those described in the first embodiment can be exhibited.

3. Third Embodiment

Figure 25:
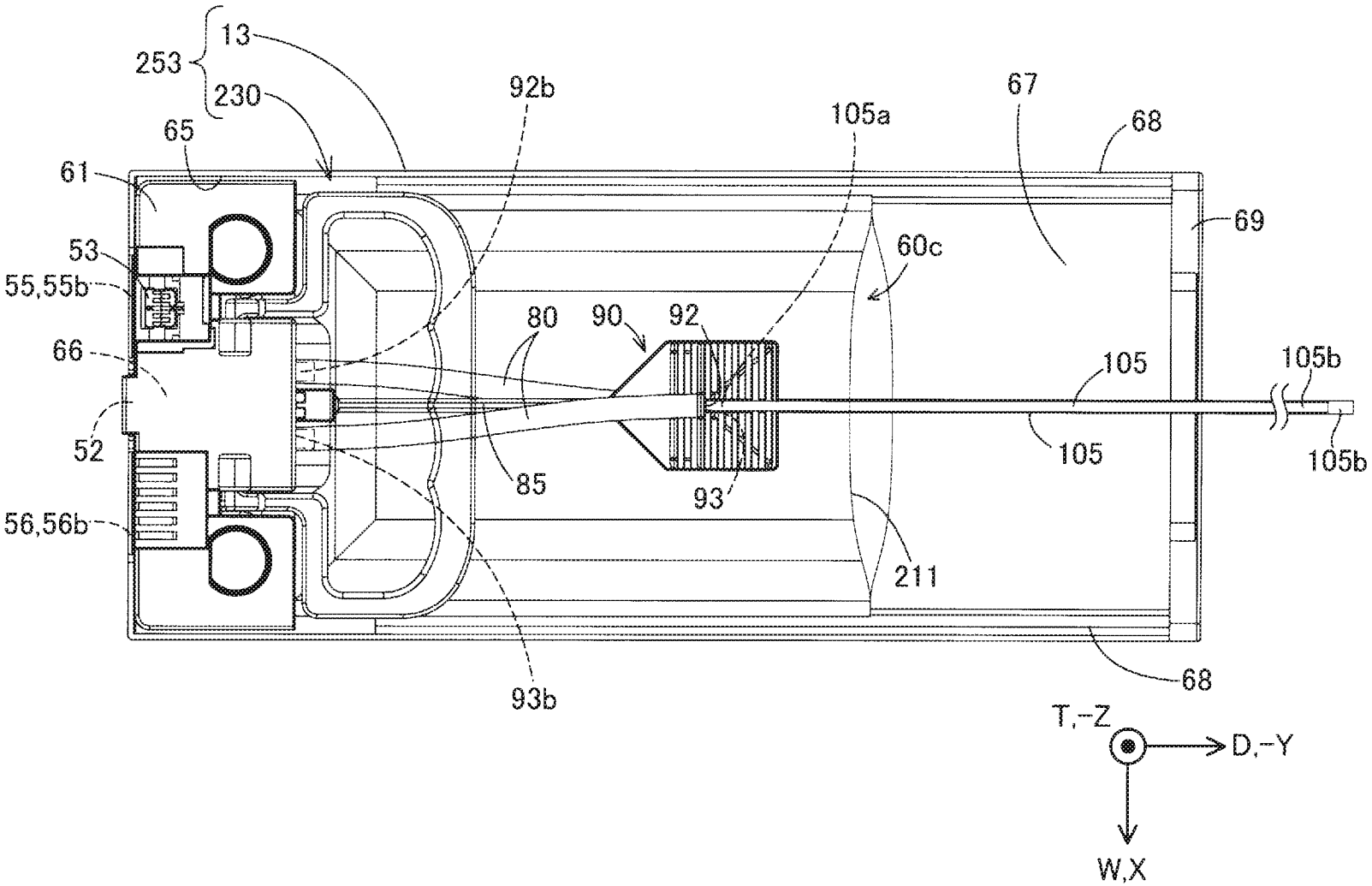
FIG. 25 is a schematic plan view illustrating a liquid supplier in a third embodiment.

FIG. 25 is a schematic plan view of an attachment body 253 in which a liquid supplier 230 of a third embodiment is mounted in the case 13, when viewed in the +Z direction. The configuration of the liquid supplier 230 of the third embodiment is almost the same as the configuration of the liquid supplier 210 of the first embodiment, except that the liquid outlet tubes 80, the coupling member 85, and the spacer member 90 are not removed from the liquid outlet member 66, and the tubes 105 are coupled to the connection ports 92*b* and 93*b* via the spacer member 90 and the liquid outlet tubes 80.

In the liquid supplier 230, the one ends 105*a* of the tubes 105 are coupled to the first introduction port 92 and the second introduction port 93 that are included in the spacer member 90 and are arranged side by side in the Z direction. With this, liquid injected into the tubes 105 from the other ends 105*b* that are arranged outside the liquid ejection device 11 is supplied to the liquid outlet member 66 via channels inside the spacer member 90 and the liquid outlet tubes 80.

The liquid supplier 230 of the third embodiment can be manufactured using manufacturing process similar to that of the liquid supplier 210 described in the first embodiment, except that the liquid outlet tubes 80, the coupling member 85, and the spacer member 90 are not removed from the liquid outlet member 66, and the tubes 105 are coupled to the spacer member 90 (refer to FIG. 20). As a result of the liquid supplier 230 being coupled to the tank 320 described in the first embodiment via the tubes 105, a liquid supply system, for supplying liquid to the liquid ejection device 11, that is similar to the liquid supply system 301 of the first embodiment can be configured. According to the liquid supplier 230 of the third embodiment, the manufacturing method thereof, and the liquid supply system, various types of effects similar to those described in the first embodiment can be exhibited.

4. Fourth Embodiment

Figure 26:
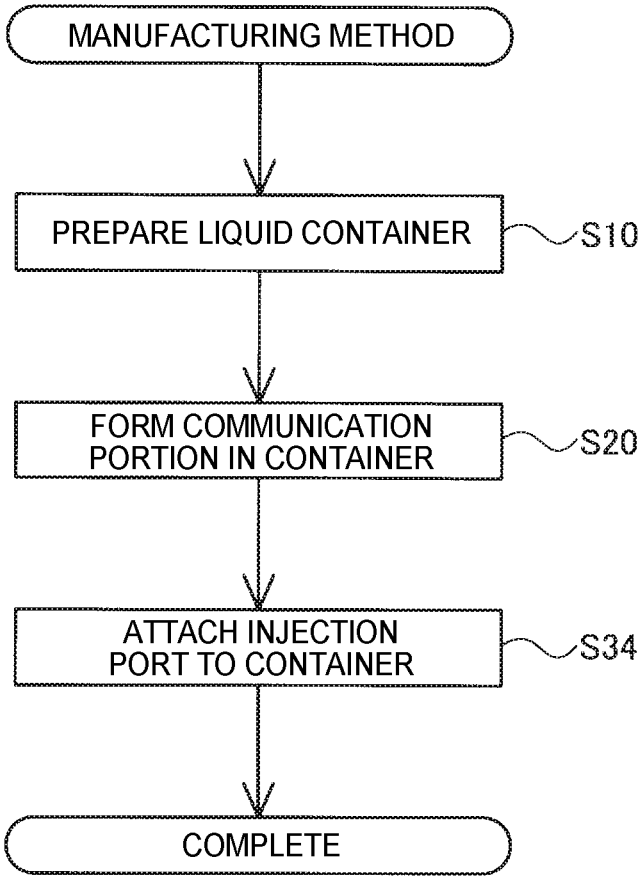
FIG. 26 is a flow diagram illustrating a liquid supplier of a fourth embodiment.
Figure 27:
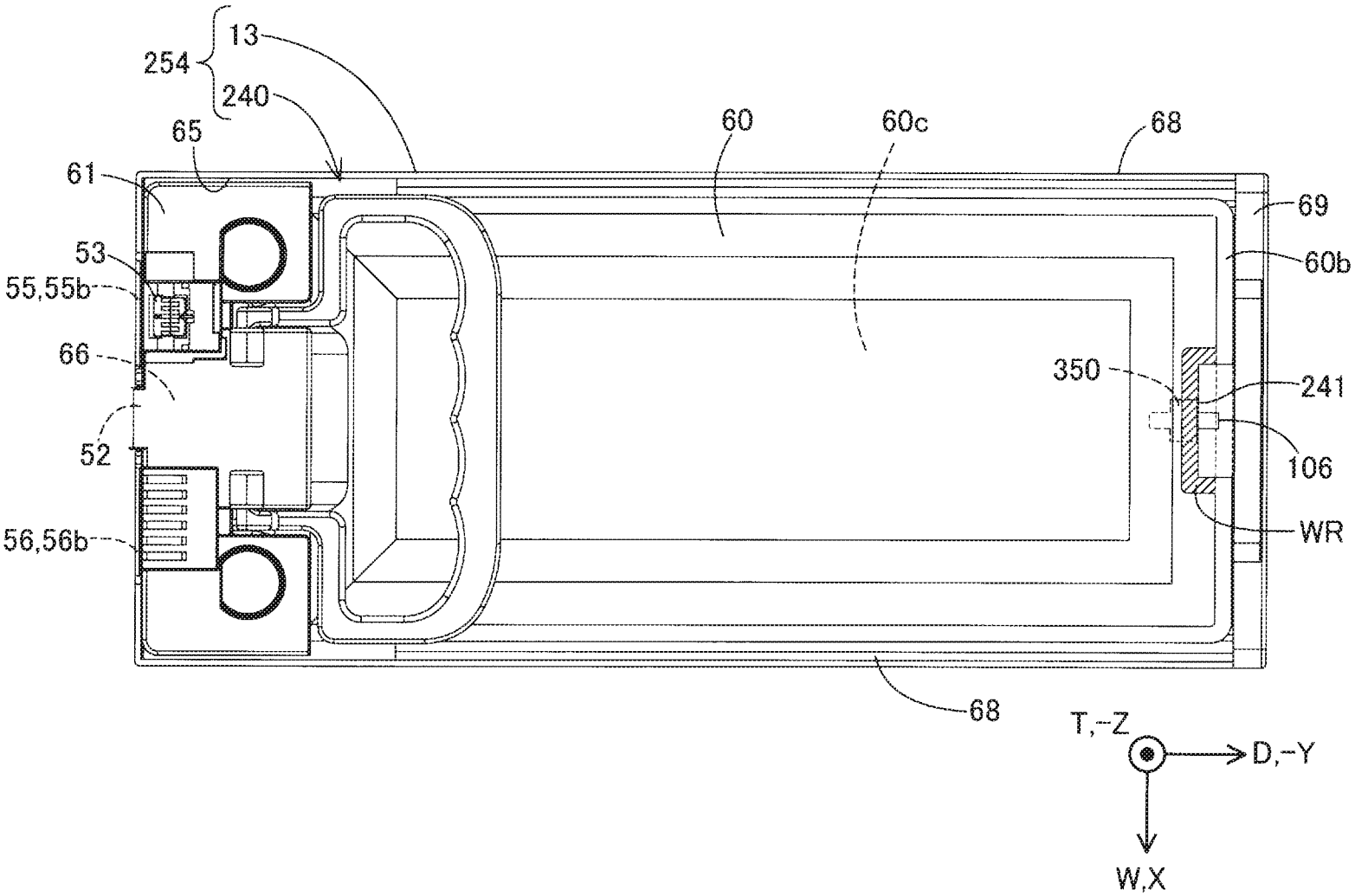
FIG. 27 is a schematic plan view illustrating the liquid supplier in the fourth embodiment.

FIG. 26 is a flow diagram illustrating a manufacturing process of a liquid supplier 240 of a fourth embodiment. FIG. 27 is a schematic plan view of an attachment body 254 in which the liquid supplier 240 of the fourth embodiment is mounted in the case 13, when viewed in the +Z direction. The liquid supplier 240 of the fourth embodiment corresponds to a liquid supplier obtained by modifying the liquid container 20 described in the first embodiment such that the inner space 60*c* of the containing portion 60 can be refilled with liquid.

The manufacturing process flow in FIG. 26 will be described with reference to FIG. 27. The manufacturing process of the liquid supplier 240 is almost the same as the manufacturing process of the first embodiment (refer to FIG. 20), except that a process in step S34 is provided instead of the process in step S30. In step S10, a liquid container 20 to be attached to the liquid ejection device 11 is prepared, similarly to the first embodiment. In step S20, a communication portion 241 is formed in the containing portion 60 of the liquid container 20. In the example in FIG. 27, the communication portion 241, which is an opening portion that is in communication with the inner space 60*c*, is formed by excising a portion of the other end portion 60*b* of the containing portion 60. Note that the position at which the communication portion 241 is formed is not limited to the other end portion 60*b* of the containing portion 60. The communication portion 241 may be provided at an end of the containing portion 60 in the X direction. The communication portion 241 may be provided at a corner of the containing portion 60. The communication portion 241 may be formed by breaking up adhesions at the end of the containing portion 60, for example.

The process in step S34 is a process in which an injection port 106 for injecting liquid to the inner space 60*c* of the containing portion 60 is attached to the communication portion 241 formed in the containing portion 60. In this process, an injection port member 350 including the injection port 106 at the end is fixed to the containing portion 60, and gaps between the injection port member 350 and the containing portion 60 are sealed. The injection port member 350 is inserted into the communication portion 241 such that the injection port 106 opens toward the outside of the containing portion 60. Then, the outer peripheral side face of the injection port member 350 around the injection port 106 is adhered to the inner peripheral edge of the communication portion 241. The communication portion 241 is adhered without a gap around the injection port member 350. In FIG. 27, an example of an adhesion region WR in step S34 is shown by hatching.

Figure 28:
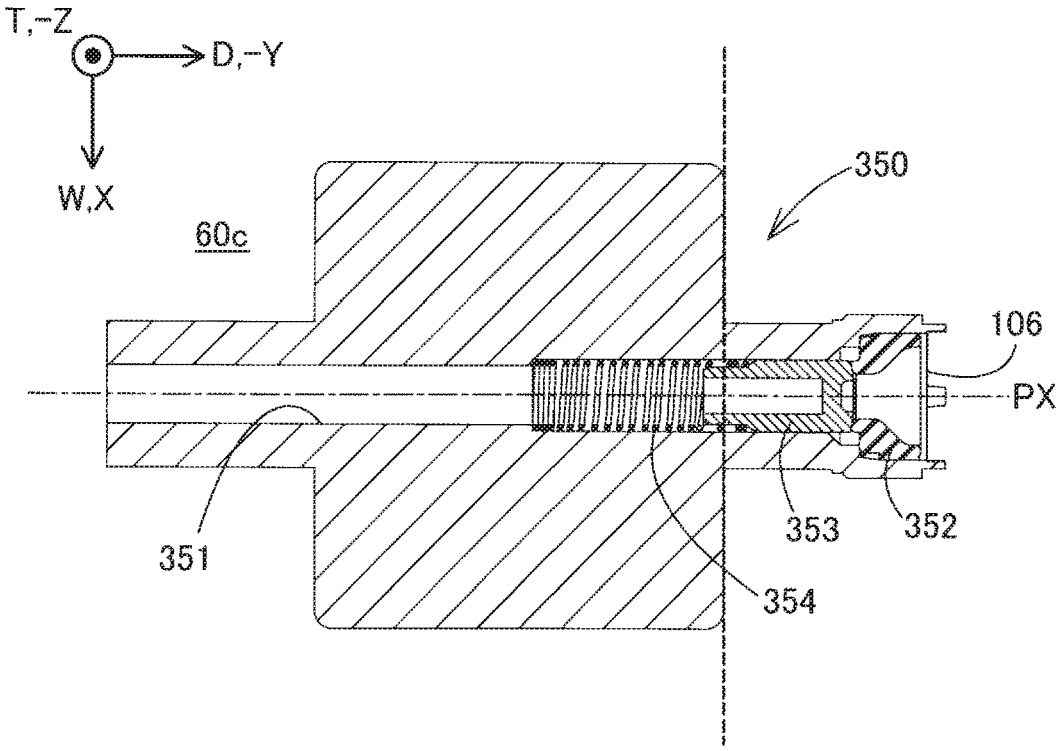
FIG. 28 is a schematic cross-sectional view of an injection port member.

FIG. 28 is a schematic cross-sectional view of the injection port member 350. The cross section in FIG. 28 passes through a central axis PX of the injection port 106, and is parallel to the X direction when the injection port member 350 is attached to the containing portion 60. The injection port member 350 is provided with a valve structure for preventing liquid from leaking from the containing portion 60 through the injection port 106. The injection port member 350 includes, on a rear end side of the injection port 106, a communication channel 351 that is in communication with the injection port 106. A ring-shaped seal member 352 provided at an inner peripheral edge of the injection port 106, a valve 353 for controlling opening/closing of the communication channel 351, and an elastic member 354 that biases the valve 353 toward the seal member 352 are arranged inside the communication channel 351 in order from the injection port 106 side.

The valve 353 is normally in a close contact with the seal member 352 by receiving a biasing force of the elastic member 354, and is in a state of sealing the communication channel 351. The valve 353 moves to a position deep inside the communication channel 351 by being pressed by a member such as an introduction needle for injecting liquid that is inserted through the injection port 106 or by receiving pressure of liquid supplied from the injection port 106. As a result of the movement of the valve 353, the sealed state of the injection port 106 realized by the valve 353 and the seal member 352 is released, and a channel that is not illustrated for bringing the injection port 106 into communication with the communication channel 351 opens. With this, liquid can be injected into the inner space 60*c* of the containing portion 60 through the injection port 106.

The following is in reference to FIG. 27. The liquid supplier 240 includes the connection member 61, which is common to the liquid container 20, that is provided with the container-side electric connector 53, the first receiving portion 55*b*, the second receiving portion 56*b*, and the liquid outlet member 66 including the liquid outlet port 52. The liquid supplier 240 is attached to the case 13 that is the same as that to which the liquid container 20 is attached, and constitutes the attachment body 254, and the attachment body 254 is attached to the liquid ejection device 11 (refer to FIG. 1). Since the liquid supplier 240 includes the connection member 61 that is common with the liquid container 20, the liquid supplier 240 is coupled to the liquid ejection device 11 using a connection method similar to that used for the liquid container 20. Therefore, the liquid supplier 240 can be easily coupled to the liquid ejection device 11, and the failure in connecting to the liquid ejection device 11 can be suppressed from occurring.

In an orientation in the attached state in which the attachment body 254 is attached to the liquid ejection device 11, the width of the liquid supplier 240 in the Z direction is smaller than the width in the Y direction and the width in the X direction. As a result of the width in the Z direction being small in this way, the arrangement orientation of the liquid supplier 240 on the case 13 is stabilized.

According to the liquid supplier 240, the containing portion 60 can be filled with liquid through the injection port 106 attached to the containing portion 60. Liquid is injected into the injection port 106 by inserting an injection needle for injecting liquid into the injection port 106 and pushing inward the valve 353 inside the injection port member 350. Alternatively, liquid is injected by pushing inward the valve 353 inside the injection port member 350 by pressure-feeding liquid using a pump or the like through a piping member such as a tube coupled to the injection port 106. Liquid can also be injected into the containing portion 60 via the injection port 106 in a state in which the liquid supplier 240 is attached to the liquid ejection device 11. Also, since the liquid supplier 240 uses the injection port member 350 including the above-described valve structure, sealing and opening of the injection port 106 can be easily performed, and the containing portion 60 can be easily and repeatedly refilled with liquid.

Figure 29:
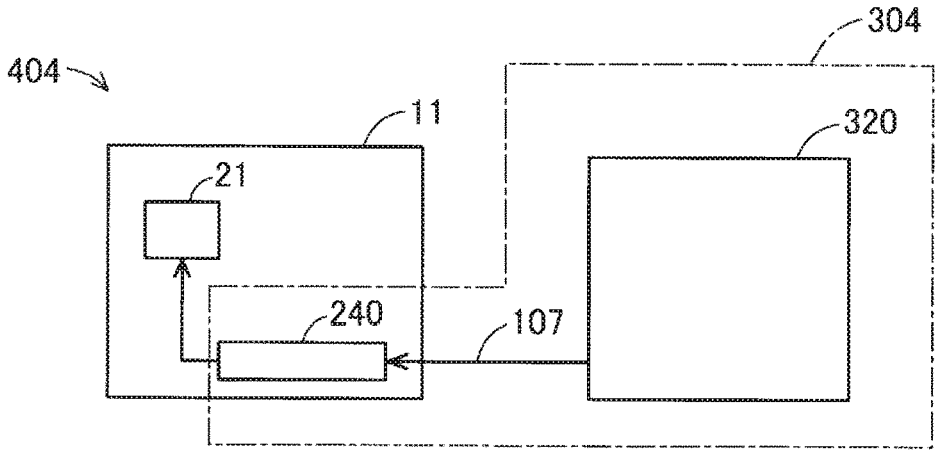
FIG. 29 is a schematic block diagram illustrating a liquid supply system in the fourth embodiment.

FIG. 29 is a schematic block diagram illustrating a configuration of a liquid supply system 304 that includes the liquid supplier 240, and a liquid ejection system 404 including the liquid supply system 304. The liquid supply system 304 and the liquid ejection system 404 are respectively almost the same as the liquid supply system 301 and the liquid ejection system 401 in the first embodiment except for the following points. In the liquid supply system 304 and the liquid ejection system 404, the liquid supplier 240 is attached to the liquid ejection device 11 instead of the liquid supplier 210 of the first embodiment, and the liquid supplier 240 and the tank 320 are coupled via the supply tube 107. The supply tube 107 is a piping member coupled to the injection port 106 of the liquid supplier 240. The supply tube 107 is constituted by a tube, for example. In the liquid supplier 240, the injection port member 350 is in a state in which the valve 353 is pushed inward by the supply tube 107 being coupled to the injection port 106, and the communication channel 351 is open. With this, the containing portion 60 of the liquid supplier 240 is refilled with liquid that is supplied from the tank 320 by suction driving of the liquid ejection device 11.

According to the liquid supplier 240 of the fourth embodiment, the containing portion 60 can be refilled with liquid through the injection port 106. Therefore, liquid can be supplied to the liquid ejection device 11 continuously over a long period of time compared with the case where the liquid is supplied to the liquid ejection device 11 using the liquid container 20. Also, the time and effort involved in replacing the liquid container 20 and discarding a used liquid container 20 can be omitted, and therefore the operating cost of the liquid ejection device 11 can be reduced. In addition, according to the liquid supplier 240 of the fourth embodiment, the manufacturing method thereof, and the liquid supply system 304, various effects described in the fourth embodiment and above-described embodiments can be exhibited including the effects obtained by the configuration in common with the liquid container 20.

5. Fifth Embodiment

Figure 30:
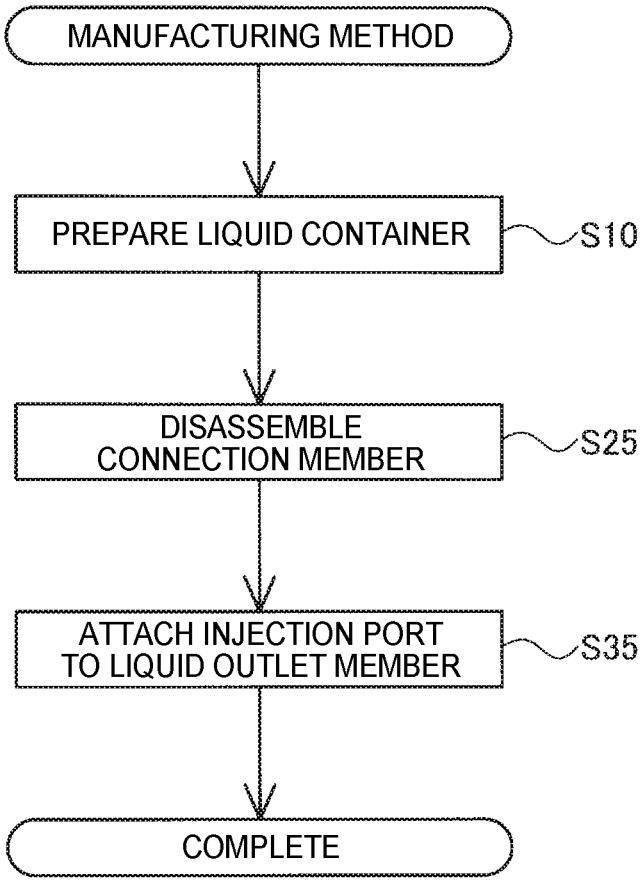
FIG. 30 is a flow diagram illustrating manufacturing process of a liquid supplier of a fifth embodiment.
Figure 31:
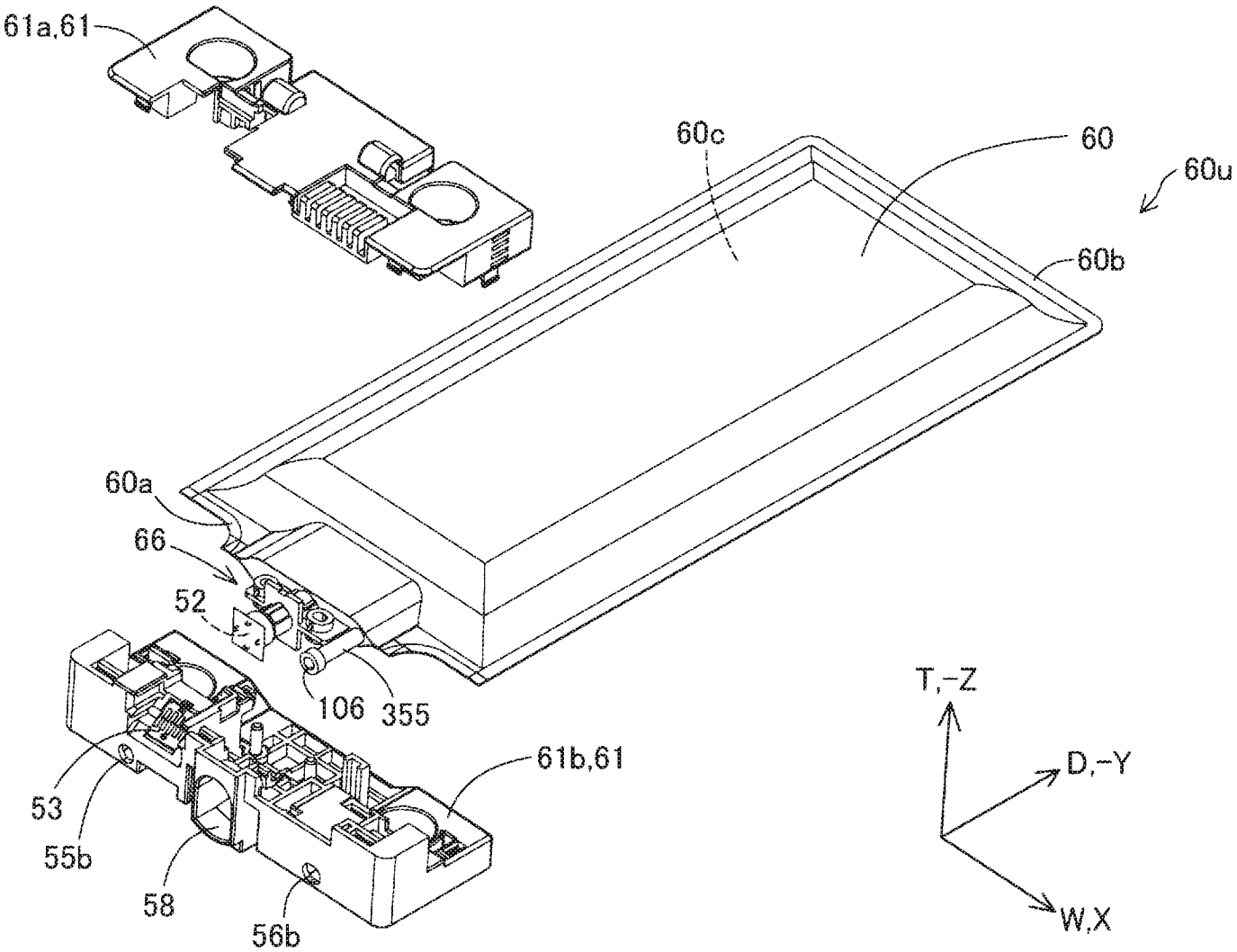
FIG. 31 is a schematic exploded perspective view illustrating the liquid supplier of the fifth embodiment.

FIG. 30 is a flow diagram illustrating a manufacturing process of a liquid supplier 250 of a fifth embodiment. FIG. 31 is a schematic exploded perspective view illustrating the liquid supplier 250 of the fifth embodiment. The liquid supplier 250 of the fifth embodiment corresponds to a liquid supplier obtained by modifying the liquid container 20 described in the first embodiment such that the inner space 60*c* of the containing portion 60 can be refilled with liquid.

The manufacturing process flow in FIG. 30 will be described with reference to FIG. 31. The manufacturing process of the liquid supplier 250 is almost the same that the manufacturing process of the first embodiment (refer to FIG. 20), except that processes in steps S25 and S35 are provided instead of the processes in steps S20 and S30. In step S10, a liquid container 20 that is attached to the liquid ejection device 11 is prepared, similarly to the first embodiment. In step S25, the connection member 61 is disassembled into the cover member 61*a* and the bottom member 61*b*, and a state is achieved in which the liquid outlet member 66 attached to the one end portion 60*a* of the containing portion 60 is exposed, as illustrated in FIG. 31. Note that the handle 62 (refer to FIGS. 4 and 5) attached to the cover member 61*a* is not illustrated in FIG. 31, for the sake of convenience.

In step S35, an injection port 106 is attached to the liquid outlet member 66. In step S35, a communication hole that is in communication with the inner space 60*c* of the containing portion 60 is formed by performing hole making processing on the liquid outlet member 66. Then, an injection port member 355 including the injection port 106 is attached in an airtight manner to the communication hole. A valve structure, similar to that in the injection port member 350 in the fourth embodiment, for preventing leakage of liquid from the containing portion 60 is desirably provided inside the injection port member 355. Then, the leading end portion of the containing portion 60 including the liquid outlet member 66 that is provided with the injection port 106 is arranged on the bottom member 61*b*, and as a result, the liquid supplier 250 is configured. Note that a configuration may be adopted in which the cover member 61*a* is remained to be removed from the bottom member 61*b*.

The bottom member 61*b* functions as a connection portion for connecting the liquid supplier 250 to the liquid ejection device 11. Hereinafter, the bottom member 61*b* may also be referred to as a "connection member 61*b*" of the liquid supplier 250. The connection member 61*b* of the liquid supplier 250 is provided with the container-side electric connector 53, the first receiving portion 55*b*, and the second receiving portion 56*b*.

Figure 32:
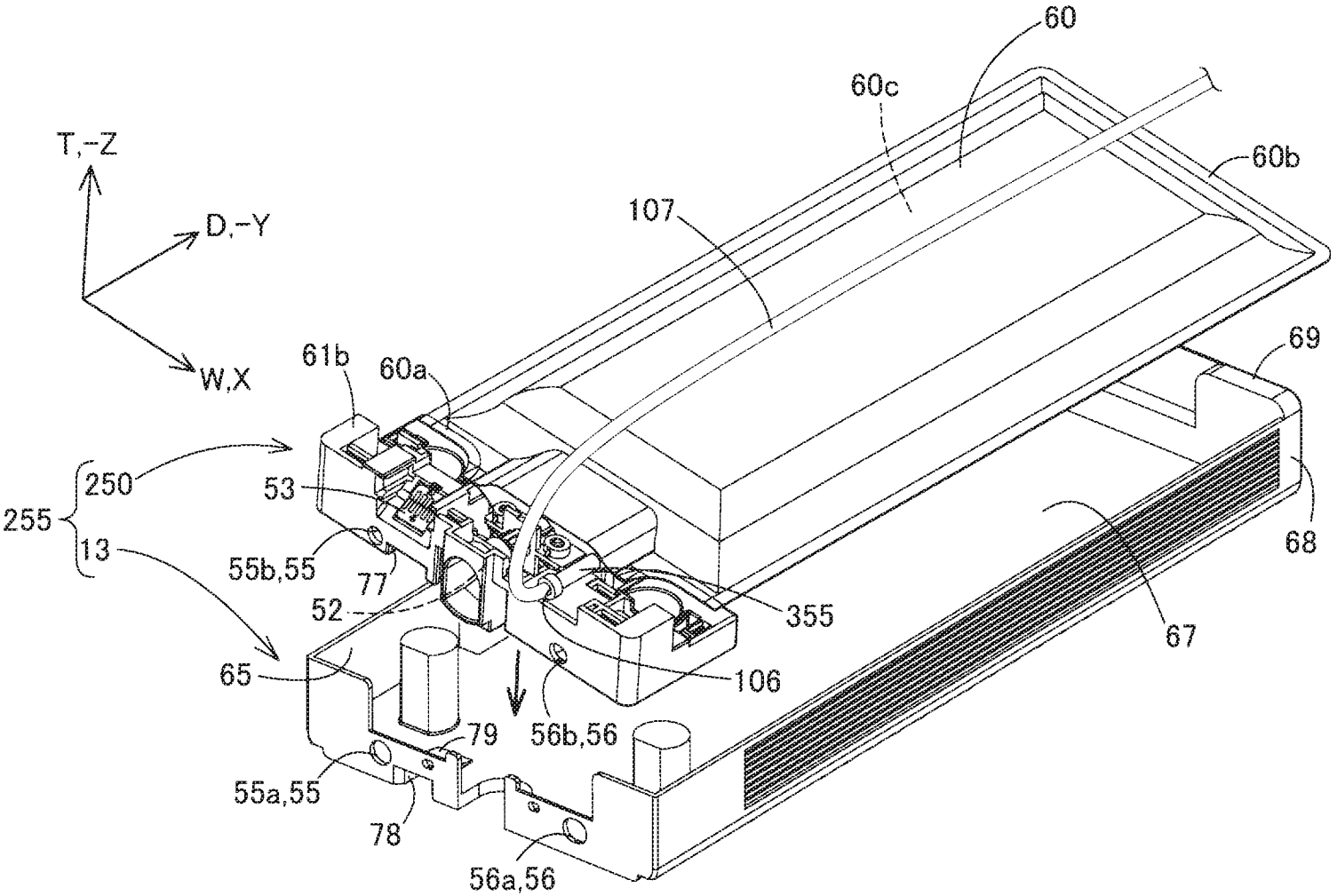
FIG. 32 is a schematic perspective view illustrating the liquid supplier of the fifth embodiment.

FIG. 32 is a schematic perspective view schematically illustrating the manner of attaching the liquid supplier 250 to the case 13. Note that the T, D, and W axes is FIG. 32 are illustrated so as to correspond to the liquid supplier 250 in the attached state orientation.

The liquid supplier 250 is attached to the case 13 that is the same as that to which the liquid container 20 is attached, and constitutes the attachment body 255, and the attachment body 255 is attached to the liquid ejection device 11 (refer to FIG. 1). When the liquid supplier 250 is attached to the case 13, the bottom member 61*b* engages with the engagement receiving portion 65 of the case 13. As a result of the liquid supplier 250 including the connection member 61*b* that constitutes a portion of the connection member 61 of the liquid container 20, the liquid supplier 250 can be coupled to the liquid ejection device 11 using a connection method similar to that used for the liquid container 20. Therefore, the liquid supplier 250 can be easily coupled to the liquid ejection device 11, and the failure in connecting to the liquid ejection device 11 can be suppressed from occurring.

In an orientation in the attached state in which the attachment body 255 is attached to the liquid ejection device 11, the width of the liquid supplier 250 in the Z direction is smaller than the width in the Y direction and the width in the X direction. As a result of the width in the Z direction being small in this way, the arrangement orientation of the liquid supplier 250 on the case 13 is stabilized.

According to the liquid supplier 250, the containing portion 60 can be filled with liquid through the injection port 106 attached to the liquid outlet member 66 in a manner similar to that described in the fourth embodiment. As a result of a supply tube 107 that is routed from the outside of the liquid ejection device 11 being coupled to the injection port 106, as shown in FIG. 32, liquid can be injected into the liquid supplier 250 even in a state in which the liquid supplier 250 is remained to be attached to the liquid ejection device 11.

Figure 33:
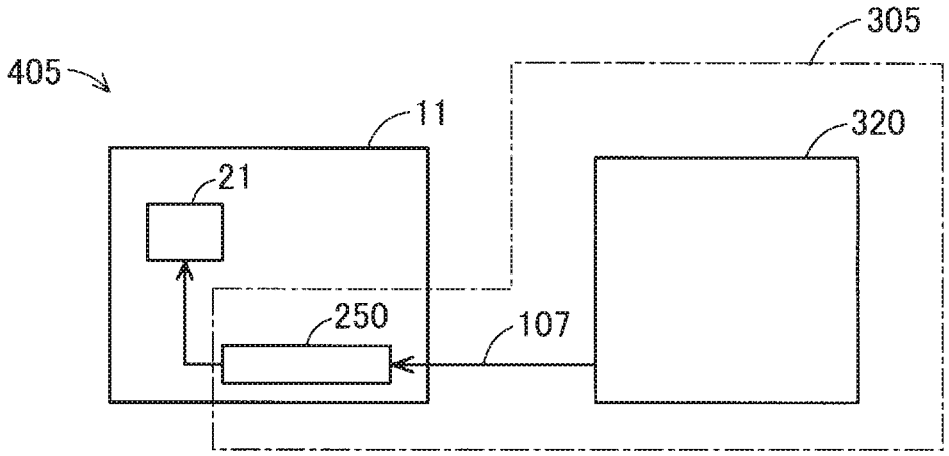
FIG. 33 is a schematic block diagram illustrating a liquid supply system in the fifth embodiment.

FIG. 33 is a schematic block diagram illustrating a liquid supply system 305 including the liquid supplier 250, and a liquid ejection system 405 including the liquid supply system 305. The liquid supply system 305 and the liquid ejection system 405 are respectively almost the same as the liquid supply system 304 and the liquid ejection system 404 of the fourth embodiment except that the liquid supplier 250 of the fifth embodiment is attached to the liquid ejection device 11 instead of the liquid supplier 240 of the fourth embodiment. In the liquid supply system 305, the containing portion 60 of the liquid supplier 250 is refilled with ink that is supplied from the tank 320 through the supply tube 107 by suction driving of the liquid ejection device 11.

According to the liquid supplier 250 of the fifth embodiment, when the amount of liquid contained in the containing portion 60 has decreased, the containing portion 60 can be refilled with liquid through the injection port 106 attached to the liquid outlet member 66. Therefore, the amount of members to be discarded can be reduced and the operation cost of the liquid ejection device 11 can be reduced, compared with the case where the liquid container 20 is replaced with new one in order to supply liquid. In addition, according to the liquid supplier 250 of the fifth embodiment, the manufacturing method thereof, and the liquid supply system 305, various effects described in the fifth embodiment and above-described embodiments can be exhibited including the effects obtained by the configuration in common with the liquid container 20.

6. Other Embodiments

Various configurations described in the above-described embodiments can be modified as follows, for example. Other embodiments to be described below are all regarded as an example of a mode for implementing the present disclosure, similar to the above embodiments.

(1) Other Embodiment 1

The containing portion 60 may be omitted in the liquid suppliers 210 to 230 in the above-described first, second, and third embodiments. When the containing portion 60 is omitted in the first and second embodiments, the width of the liquid supplier 210 or 220 in the Y direction in the attachment orientation corresponds to the width of the connection member 61 in the Y direction. When the containing portion 60 is omitted in the third embodiment, the width of the liquid supplier 230 in the Y direction in the attachment orientation corresponds to the length of a portion including the connection member 61, the coupling member 85, and the spacer member 90.

(2) Other Embodiment 2

In the liquid suppliers 240 and 250 in the fourth and fifth embodiments, the valve structures inside the injection port members 350 and 355 may be omitted. The configuration may be such that a tube including the injection port 106 at the end is attached to the liquid suppliers 240 and 250. In this case, a detachable plug member or cover member for sealing the injection port 106 may be attached to the injection port members 350 and 355. Also, a known valve structure that is different from that described in the fourth embodiment may be applied to the injection port members 350 and 355.

(3) Other Embodiment 3

The configurations of the liquid suppliers 210 to 250 of the above-described embodiments can be applied to a liquid supplier that is attached to any liquid ejection device that ejects liquid other than ink. For example, the configurations of the liquid suppliers 210 to 250 can be applied to a liquid supplier that is attached to the following various liquid ejection devices.

(a) Image recording apparatuses such as a facsimile apparatus (b) Color material ejection recording apparatuses used to manufacture color filters for image display apparatuses such as a liquid crystal display (c) Electrode material ejection apparatuses used to form electrodes for organic EL (Electro Luminescence) displays, field emission displays (FED), or the like (d) Liquid consuming apparatuses that eject liquid containing biological organic matter used to manufacture biochips (e) Sample ejection apparatuses serving as precision pipettes (f) Lubricating oil ejection apparatuses (g) Resin solution ejection apparatuses (h) Liquid consuming apparatuses that perform pinpoint ejection of lubricating oil to precision machines such as a watch and a camera (i) Liquid consuming apparatuses that eject a transparent resin solution such as a UV-cured resin solution onto substrates in order to form micro-hemispherical lenses (optical lenses) or the like used in optical communication elements or the like (j) Liquid consuming apparatuses that eject acid or alkaline etchant in order to etch substrates or the like (k) Liquid consuming apparatuses that include liquid consumption heads for discharging a very small amount of any other kind of droplet.

Note that the "droplet" refers to a state of the liquid discharged from liquid ejection devices, and includes droplets having a granular shape, a tear-drop shape, and a shape with a thread-like trailing end. The "Liquid" mentioned here need only be a material that can be consumed by liquid ejection devices. For example, the "liquid" need only be a material in a state where a substance is in a liquid phase, and a liquid material having a high or low viscosity, sol, gel water, and other liquid materials such as inorganic solvent, organic solvent, solution, liquid resin, and liquid metal (metallic melt) are also included as a "liquid". Furthermore, the "liquid" is not limited to being a single-state substance, and also includes particles of a functional material made from solid matter, such as pigment or metal particles, that are dissolved, dispersed, or mixed in a solvent, or the like. Representative examples of the liquid include ink such as that described in the above embodiment, liquid crystal, or the like. Here, the "ink" encompasses general water-based ink and oil-based ink, as well as various types of liquid compositions such as gel ink and hot melt ink.

7. Other Aspects

The present disclosure is not limited to the above-described embodiments and working examples, and can be realized as various aspects without departing from the gist of the invention. For example, the present disclosure can be realized as the following aspects. The technical features in the embodiments that correspond to the technical features in the aspects described in the following may be replaced or combined as appropriate in order to solve a part of, or the entire problem of the present disclosure, or to achieve some or all of the effects of the present disclosure. The technical features that are not described as essential in this specification may be deleted as appropriate.

(1) A first aspect is provided as a liquid supplier. A direction parallel to a gravity direction is defined as a Z direction, a direction of the Z direction that is the same as the gravity direction is defined as a +Z direction, a direction of the Z direction that is opposite to the gravity direction is defined as a −Z direction, a direction orthogonal to the Z direction is defined as a Y direction, one direction of the Y direction is defined as a +Y direction, the other direction of the Y direction is defined as a −Y direction, a direction orthogonal to the Z direction and the Y direction is defined as a X direction, one direction of the X direction is defined as a +X direction, and the other direction of the X direction is defined as a −X direction. A liquid supplier of this aspect configured to be attached to and detached from a case of a liquid ejection device that includes: a case storage inside the housing; the case that moves along the +Y direction in order to be inserted into the case storage; a liquid introduction member located at an end of the case storage on the +Y direction side; a device-side electric connector located at the end of the case storage on the +Y direction side; and a first positioning portion and a second positioning portion located at the end of the case storage on the +Y direction side. The liquid supplier of this aspect includes a connection member located at an end of the case on the +Y direction side when the liquid supplier is in an attached state of being attached to the liquid ejection device. The connection member includes a liquid outlet member that leads out liquid to be supplied to the liquid ejection device. The liquid outlet member includes a liquid outlet port that is located on the +Y direction side on the liquid outlet member and receives the liquid introduction member in the attached state. The liquid outlet member includes a connection port that is located on the −Y direction side on the liquid outlet member and is in communication with the liquid outlet port. The connection member includes a container-side electric connector that, in the attached state, comes into electrical contact with the device-side electric connector while receiving at least a force having a component in the +Z direction from the device-side electric connector. The connection member includes a first receiving portion that receives the first positioning portion in the attached state. The first receiving portion is located on the −X direction from the liquid outlet member. The connection member includes a second receiving portion that receives the second positioning portion in the attached state. The second receiving portion is located on the +X direction from the liquid outlet member. The liquid supplier of this aspect includes a tube. The tube has one end coupled to the connection port, and has an other end coupled to a liquid tank located outside the liquid ejection device in the attached state. The liquid supplier of this aspect has a width in the Z direction which is smaller than a width in the Y direction and a width in the X direction in an orientation in the attached state.

According to the liquid supplier of this aspect, liquid can be supplied to the liquid ejection device from the outside of the liquid ejection device through the tube of the liquid supplier. If this liquid supplier is attached to the liquid ejection device, the time and effort involved in replacing the liquid container and discarding a used liquid container can be omitted, compared with a case where a liquid container is used that is replaced when the containing amount of liquid is reduced below a lower limit amount. Therefore, the increase in operating cost of the liquid ejection device can be suppressed.

(2) A second aspect is provided as a liquid supply system. A liquid supply system of this aspect includes the liquid supplier of the above-described aspect and the liquid tank coupled to the other end of the tube. The liquid supply system of the second aspect supplies the liquid in the tank to the liquid ejection device through the tube.

According to the liquid supply system of this aspect, liquid in the tank can be supplied to the liquid ejection device through the liquid supplier. Therefore, tasks of replacing the liquid container and discarding a used liquid container can be omitted, which need to be performed when the liquid is supplied to the liquid ejection device using a liquid container that is replaced when the containing amount of the liquid is reduced below a lower limit amount, and the efficiency can be improved.

(3) A third aspect is provided as a liquid supplier. A direction parallel to a gravity direction is defined as a Z direction, a direction of the Z direction that is the same as the gravity direction is defined as a +Z direction, a direction of the Z direction that is opposite to the gravity direction is defined as a −Z direction, a direction orthogonal to the Z direction is defined as a Y direction, one direction of the Y direction is defined as a +Y direction, the other direction of the Y direction is defined as a −Y direction, a direction orthogonal to the Z direction and the Y direction is defined as a X direction, one direction of the X direction is defined as a +X direction, and the other direction of the X direction is defined as a −X direction. The liquid supplier of this aspect configured to be attached to and detached from a case of a liquid ejection device that includes: a case storage; the case that moves along the +Y direction in order to be inserted into the case storage; a liquid introduction member located at an end of the case storage on the +Y direction side; a device-side electric connector located at the end of the case storage on the +Y direction side; and a first positioning portion and a second positioning portion located at the end of the case storage on the +Y direction side. The liquid supplier of this aspect includes a containing portion that contains a liquid. The containing portion includes an injection port for injecting the liquid into an inside of the containing portion. The liquid supplier of this aspect includes a connection member located at an end of the containing portion on the +Y direction side when the liquid supplier is in an attached state of being attached to the liquid ejection device. The connection member includes a liquid outlet port that receives the liquid introduction member in the attached state. The connection member includes a container-side electric connector that, in the attached state, comes into electrical contact with the device-side electric connector while receiving at least a force having a component in the +Z direction from the device-side electric connector. The connection member includes a first receiving portion that receives the first positioning portion in the attached state. The first receiving portion is located on the −X direction from the liquid outlet member. The connection member includes a second receiving portion that receives the second positioning portion in the attached state. The second receiving portion is located on the +X direction from the liquid outlet member. The liquid supplier of this aspect has a width in the Z direction which is smaller than a width in the Y direction and a width in the X direction in an orientation in the attached state.

According to the liquid supplier of this aspect, the containing portion can be refilled with liquid through the injection port provided in the containing portion. If this liquid supplier is attached to the liquid ejection device, the time and effort involved in replacing the liquid container and discarding a used liquid container can be omitted, compared with a case where a liquid container is used that is replaced when the containing amount of liquid is reduced below a lower limit amount. Therefore, the increase in operating cost of the liquid ejection device can be suppressed.

(4) A fourth aspect is provided as a liquid supply system. The liquid supply system of this aspect includes the liquid supplier of the above-described aspect, a supply tube coupled to the injection port, and a liquid tank that contains the liquid and is coupled to the supply tube. The liquid supply system of the fourth aspect supplies the liquid in the tank to the liquid ejection device.

According to the liquid supply system of this aspect, liquid in the tank can be supplied to the liquid ejection device through the liquid supplier. Therefore, tasks of replacing the liquid container and discarding a used liquid container can be omitted, which need to be performed when the liquid is supplied to the liquid ejection device using a liquid container that is replaced when the containing amount of the liquid is reduced below a lower limit amount, and the efficiency can be improved.

(5) A fifth aspect is provided as a liquid supplier. A direction parallel to a gravity direction is defined as a Z direction, a direction of the Z direction that is the same as the gravity direction is defined as a +Z direction, a direction of the Z direction that is opposite to the gravity direction is defined as a −Z direction, a direction orthogonal to the Z direction is defined as a Y direction, one direction of the Y direction is defined as a +Y direction, the other direction of the Y direction is defined as a −Y direction, a direction orthogonal to the Z direction and the Y direction is defined as a X direction, one direction of the X direction is defined as a +X direction, and the other direction of the X direction is defined as a −X direction. The liquid supplier of this aspect configured to be attached to and detached from a case of a liquid ejection device that includes: a case storage; the case that moves along the +Y direction in order to be inserted into the case storage; a liquid introduction member located at an end of the case storage on the +Y direction side; a device-side electric connector located at the end of the case storage on the +Y direction side; and a first positioning portion and a second positioning portion located at the end of the case storage on the +Y direction side toward the −Y direction side. The liquid supplier of this aspect includes a containing portion that contains liquid. The liquid supplier of this aspect includes a liquid outlet member that is attached to an end of the containing portion on the +Y direction side The liquid outlet member includes an injection port for injecting the liquid into an inside of the containing portion. The liquid supplier of this aspect includes a connection member located at the end on the +Y direction side when the liquid supplier is in an attached state of being attached to the liquid ejection device. The connection member includes a container-side electric connector that, in the attached state, comes into electrical contact with the device-side electric connector while receiving at least a force having a component in the +Z direction from the device-side electric connector. The connection member includes a first receiving portion that receives the first positioning portion in the attached state. The first receiving portion is located on the −X direction from the liquid outlet member. The connection member includes a second receiving portion that receives the second positioning portion in the attached state. The second receiving portion is located on the +X direction from the liquid outlet member. The liquid supplier of this aspect has a width of the liquid supplier in the Z direction which is smaller than a width in the Y direction and a width in the X direction in an orientation in the attached state.

According to the liquid supplier of this aspect, the containing portion can be refilled with liquid through the injection port provided in the liquid outlet member. If this liquid supplier is attached to the liquid ejection device, the time and effort involved in replacing the liquid container and discarding a used liquid container can be omitted, compared with a case where a liquid container is used that is replaced when the containing amount of liquid is reduced below a lower limit amount. Therefore, the increase in operating cost of the liquid ejection device can be suppressed.

(6) A sixth aspect is provided as a liquid supply system. The liquid supply system of this aspect includes the liquid supplier of the above-described aspect, a supply tube coupled to the injection port, and a tank that contains the liquid and is coupled to the supply tube. The liquid supply system of the sixth aspect supplies the liquid in the tank to the liquid ejection device.

According to the liquid supply system of this aspect, liquid in the tank can be supplied to the liquid ejection device through the liquid supplier. Therefore, tasks of replacing the liquid container and discarding a used liquid container can be omitted, which need to be performed when the liquid is supplied to the liquid ejection device using a liquid container that is replaced when the containing amount of the liquid is reduced below a lower limit amount, and the efficiency can be improved.

(7) A seventh aspect is provided as a manufacturing method of a liquid supplier. A direction parallel to a gravity direction is defined as a Z direction, a direction of the Z direction that is the same as the gravity direction is defined as a +Z direction, a direction of the Z direction that is opposite to the gravity direction is defined as a −Z direction, a direction orthogonal to the Z direction is defined as a Y direction, one direction of the Y direction is defined as a +Y direction, the other direction of the Y direction is defined as a −Y direction, a direction orthogonal to the Z direction and the Y direction is defined as a X direction, one direction of the X direction is defined as a +X direction, and the other direction of the X direction is defined as a −X direction. The manufacturing method of this aspect uses a liquid container configured to be attached to and detached from a case of a liquid ejection device including: a case storage inside the housing; the case that moves along the +Y direction in order to be inserted into the case storage; a liquid introduction member located at an end of the case storage on the +Y direction side; a device-side electric connector located at the end of the case storage on the +Y direction side; and a first positioning portion and a second positioning portion located at the end of the case storage on the +Y direction side. The manufacturing method of this aspect includes preparing the liquid container. The liquid container has a width in the Z direction being smaller than a width in the Y direction and a width in the X direction in an orientation in an attached state of being attached to the liquid ejection device. The liquid container includes a containing portion that includes an inner space for containing liquid. The liquid container includes a connection member located at an end on the +Y direction side when the liquid container is in an attached state of being attached to the liquid ejection device. The connection member includes a liquid outlet member that leads out the liquid inside the containing portion. The liquid outlet member includes a liquid outlet port that is located on the +Y direction side on the liquid outlet member and receives the liquid introduction member in the attached state. The liquid outlet member includes a connection port that is located on a −Y direction side on the liquid outlet member and is in communication with the liquid outlet port. The liquid connection member includes a container-side electric connector that, in the attached state, comes into electrical contact with the device-side electric connector while receiving at least a force having a component in the +Z direction from the device-side electric connector. The connection member includes a first receiving portion that receives the first positioning portion in the attached state The first receiving portion is located on the −X direction from the liquid outlet member. The connection member includes a second receiving portion that receives the second positioning portion in the attached state. The second receiving portion is located on the +X direction from the liquid outlet member. The manufacturing method of this aspect includes providing a communication portion that is in communication with the inside of the containing portion. The manufacturing method of this aspect includes inserting a tube through which liquid to be supplied to the liquid ejection device flows, to the inside of the containing portion via the communication portion, and connecting the tube to the connection port.

According to the manufacturing method of this aspect, a liquid container that is attached to the liquid ejection device is repurposed, and the liquid supplier that is attached to the liquid ejection device, and can supply liquid to the liquid ejection device through the tube can be obtained, and as a result, the efficiency is improved.

(8) An eighth aspect is provided as a manufacturing method of a liquid supplier. A direction parallel to a gravity direction is defined as a Z direction, a direction of the Z direction that is the same as the gravity direction is defined as a +Z direction, a direction of the Z direction that is opposite to the gravity direction is defined as a −Z direction, a direction orthogonal to the Z direction is defined as a Y direction, one direction of the Y direction is defined as a +Y direction, the other direction of the Y direction is defined as a −Y direction, a direction orthogonal to the Z direction and the Y direction is defined as a X direction, one direction of the X direction is defined as a +X direction, and the other direction of the X direction is defined as a −X direction. The manufacturing method of this aspect uses a liquid container configured to be attached to and detached from a case of a liquid ejection device including: a case storage; the case that moves along the +Y direction in order to be inserted into the case storage; a liquid introduction member located at an end of the case storage on the +Y direction side; a device-side electric connector located at the end of the case storage on the +Y direction side; and a first positioning portion and a second positioning portion located at the end of the case storage on the +Y direction side. The manufacturing method of this aspect includes preparing a liquid container. The liquid container has a width in the Z direction being smaller than a width in the Y direction and a width in the X direction in an orientation in an attached state of being attached to the liquid ejection device. The liquid container includes a containing portion that includes an inner space for containing a liquid. The liquid container includes a connection member located at the end on the +Y direction side when the liquid container is in an attached state of being attached to the liquid ejection device The connection member includes a liquid outlet port that receives the liquid introduction member in the attached state. The connection member includes a container-side electric connector that, in the attached state, comes into electrical contact with the device-side electric connector while receiving at least a force having a component in the +Z direction from the device-side electric connector. The connection member includes a first receiving portion that receives the first positioning portion in the attached state. The first receiving portion is located on the −X direction from the liquid outlet member. The connection member includes a second receiving portion that receives the second positioning portion in the attached state. The second receiving portion is located on the +X direction from the liquid outlet member. The manufacturing method of this aspect includes providing a communication portion that is in communication with the inside of the containing portion. The manufacturing method of this aspect includes attaching an injection port for injecting the liquid to the inside of the containing portion to the communication portion.

According to the manufacturing method of this aspect, a liquid container that is attached to the liquid ejection device is repurposed, and the liquid supplier that is attached to the liquid ejection device, and can supply liquid to the liquid ejection device through the tube can be obtained, and as a result, the efficiency is improved.

(9) A ninth aspect is provided as a manufacturing method of a liquid supplier. A direction parallel to a gravity direction is defined as a Z direction, a direction of the Z direction that is the same as the gravity direction is defined as a +Z direction, a direction of the Z direction that is opposite to the gravity direction is defined as a −Z direction, a direction orthogonal to the Z direction is defined as a Y direction, one direction of the Y direction is defined as a +Y direction, the other direction of the Y direction is defined as a −Y direction, a direction orthogonal to the Z direction and the Y direction is defined as a X direction, one direction of the X direction is defined as a +X direction, and the other direction of the X direction is defined as a −X direction. The manufactured of this aspect uses a liquid container configured to be attached to and detached from a case of a liquid ejection device including: a case storage; the case that moves along the +Y direction in order to be inserted into the case storage; a liquid introduction member located at an end of the case storage on the +Y direction side; a device-side electric connector located at the end of the case storage on the +Y direction side; and a first positioning portion and a second positioning portion located at the end of the case storage on the +Y direction side. The manufacturing method of this aspect includes preparing a liquid container. The liquid container has a width in a Z direction being smaller than a width in a Y direction and a width in a X direction in an orientation in an attached state of being attached to the liquid ejection device. The liquid container includes a containing portion that includes an inner space for containing liquid. The liquid container includes a liquid outlet member that leads out liquid to be supplied to the liquid ejection device. The liquid outlet member includes a liquid outlet port that receive the liquid introduction member in the attached state. The liquid outlet member is attached to an end of the containing portion on the +Y direction side. The liquid container includes a connection member located at the end on the +Y direction side when the liquid container is in an attached state of being attached to the liquid ejection device. The connection member includes a container-side electric connector that, in the attached state, comes into electrical contact with the device-side electric connector while receiving at least a force having a component in the +Z direction from the device-side electric connector. The connection member includes a first receiving portion that receives the first positioning portion in the attached state. The first receiving portion is located on the −X direction from the liquid outlet member. The connection member includes a second receiving portion that receives the second positioning portion in the attached state. the second receiving portion is located on the +X direction from the liquid outlet member. The manufacturing method of this aspect includes attaching an injection port for injecting the liquid to the inside of the containing portion to the liquid outlet member.

According to the manufacturing method of this aspect, a liquid container that is attached to the liquid ejection device is repurposed, and the liquid supplier that is attached to the liquid ejection device, and can supply liquid to the liquid ejection device through the tube can be obtained, and as a result, the efficiency is improved.

The present disclosure can also be realized in various aspects other than the liquid supplier, the liquid supply system, and the manufacturing method of the liquid supplier. For example, the present disclosure can be realized in aspects such as a liquid ejection device including the liquid supplier, a method of refilling a liquid container with liquid, and a method of modifying a liquid container.

What is claimed is:

1. A liquid supplier that is configured to be attached to and detached from a case of a liquid ejection device including a case storage; the case that moves along a +Y direction in order to be inserted into the case storage; a liquid introduction member located at an end of the case storage on the +Y direction side; a device-side electric connector located at the end of the case storage on the +Y direction side; and a first positioning portion and a second positioning portion located at the end of the case storage on the +Y direction side, the liquid supplier comprising:

(A) a connection member located at an end of the case on the +Y direction side when the liquid supplier is in an attached state of being attached to the liquid ejection device, the connection member including a liquid outlet member that leads out liquid to be supplied to the liquid ejection device, the liquid outlet member includes a liquid outlet port that is located on the +Y direction side on the liquid outlet member and receives the liquid introduction member in the attached state, and includes a connection port that is located on a Y direction side on the liquid outlet member and is in communication with the liquid outlet port, a container-side electric connector that, in the attached state, comes into electrical contact with the device-side electric connector while receiving at least a force having a component in a +Z direction from the device-side electric connector, a first receiving portion that receives the first positioning portion in the attached state, the first receiving portion is located on a X direction from the liquid outlet member, and a second receiving portion that receives the second positioning portion in the attached state, the second receiving portion is located on a +X direction from the liquid outlet member; and (B) a tube that has one end coupled to the connection port, and has an other end coupled to a liquid tank located outside the liquid ejection device; and (C) a containing portion defining an inner space and including a communication portion in communication with the inner space and formed by cutting off a portion of the containing portion, wherein the tube is in communication with the liquid outlet port through the communication portion, wherein a main body of the connection member, which is configured to be separated from the case, has a width in the Z direction being smaller than a width in the Y direction and a width in the X direction, in an orientation where the liquid supplier is in the attached state, the connection member includes a cover member and a bottom member, wherein a majority of an insertion portion is provided in the bottom member, the insertion portion provided to engage an engagement receiving portion of the case, and a direction parallel to a gravity direction is defined as the Z direction, a direction of the Z direction that is the same as the gravity direction is defined as the +Z direction, a direction of the Z direction that is opposite to the gravity direction is defined as a −Z direction, a direction orthogonal to the Z direction is defined as the Y direction, one direction of the Y direction is defined as the +Y direction, the other direction of the Y direction is defined as the −Y direction, a direction orthogonal to the Z direction and the Y direction is defined as the X direction, one direction of the X direction is defined as a +X direction, and the other direction of the X direction is defined as the −X direction.

2. A liquid supply system comprising:

the liquid supplier according to claim 1; and the liquid tank coupled to the other end of the tube, wherein a liquid in the liquid tank is supplied to the liquid ejection device through the tube.

3. A liquid supplier that is configured to be attached to and detached from a case of a liquid ejection device including a case storage; the case that moves along a +Y direction in order to be inserted into the case storage; a liquid introduction member located at an end of the case storage on the +Y direction side; a device-side electric connector located at the end of the case storage on the +Y direction side; and a first positioning portion and a second positioning portion located at the end of the case storage on the +Y direction side, the liquid supplier comprising:

(A) a containing portion that contains a liquid, the containing portion including an injection port for injecting the liquid into an inside of the containing portion; and (B) a connection member located at an end of the containing portion on the +Y direction side when the liquid supplier is in an attached state of being attached to the liquid ejection device, the connection member including a liquid outlet port that receives the liquid introduction member in the attached state, a container-side electric connector that, in the attached state, comes into electrical contact with the device-side electric connector while receiving at least a force having a component in a +Z direction from the device-side electric connector, a first receiving portion that receives the first positioning portion in the attached state, the first receiving portion is located on a −X direction from the liquid outlet member, and a second receiving portion that receives the second positioning portion in the attached state, the second receiving portion is located on a +X direction from the liquid outlet member, wherein a main body of the connection member, which is configured to be separated from the case, has a width in the Z direction being smaller than a width in the Y direction and a width in the X direction in an orientation where the liquid supplier is in the attached state, the connection member includes a cover member and a bottom member, wherein a majority of an insertion portion is provided in the bottom member, the insertion portion provided to engage an engagement receiving portion of the case, and a direction parallel to a gravity direction is defined as the Z direction, a direction of the Z direction that is the same as the gravity direction is defined as the +Z direction, a direction of the Z direction that is opposite to the gravity direction is defined as a −Z direction, a direction orthogonal to the Z direction is defined as the Y direction, one direction of the Y direction is defined as the +Y direction, the other direction of the Y direction is defined as a −Y direction, a direction orthogonal to the Z direction and the Y direction is defined as the X direction, one direction of the X direction is defined as the +X direction, and the other direction of the X direction is defined as the −X direction.

4. A liquid supply system comprising:

the liquid supplier according to claim 3;

a supply tube coupled to the injection port; and a tank that contains the liquid, and is coupled to the supply tube, wherein the liquid in the tank is supplied to the liquid ejection device.

5. A liquid supplier that is configured to be attached to and detached from a case of a liquid ejection device including a housing provided with a case storage inside the housing; the case that moves along a +Y direction in order to be inserted into the case storage; a liquid introduction member located at an end of the case storage on the +Y direction side; a device-side electric connector located at the end of the case storage on the +Y direction side; and a first positioning portion and a second positioning portion located at the end of the case storage on the +Y direction side, the liquid supplier comprising:

(A) a containing portion that contains liquid;

(B) a liquid outlet member that is attached to an end of the containing portion on the +Y direction side, and receives the liquid introduction member in the attached state, the liquid outlet member includes an injection port for injecting the liquid into an inside of the containing portion; and (C) a connection member located at the end on the +Y direction side when the liquid supplier is in an attached state of being attached to the liquid ejection device, the connection member including a liquid outlet port that receives the liquid introduction member in the attached state, a container-side electric connector that, in the attached state, comes into electrical contact with the device-side electric connector while receiving at least a force having a component in a +Z direction from the device-side electric connector, a first receiving portion that receives the first positioning portion in the attached state, the first receiving portion is located on a −X direction from the liquid outlet member, and a second receiving portion that receives the second positioning portion in the attached state, the second receiving portion is located on a +X direction from the liquid outlet member, wherein a main body of the connection member has a width in the Z direction being smaller than a width in the Y direction and a width in the X direction in an orientation where the liquid supplier is in the attached state, the connection member includes a cover member and a bottom member, wherein a majority of an insertion portion is provided in the bottom member, the insertion portion provided to engage an engagement receiving portion of the case, and a direction parallel to a gravity direction is defined as the Z direction, a direction of the Z direction that is the same as the gravity direction is defined as the +Z direction, a direction of the Z direction that is opposite to the gravity direction is defined as a −Z direction, a direction orthogonal to the Z direction is defined as the Y direction, one direction of the Y direction is defined as the +Y direction, the other direction of the Y direction is defined as a −Y direction, a direction orthogonal to the Z direction and the Y direction is defined as the X direction, one direction of the X direction is defined as the +X direction, and the other direction of the X direction is defined as the −X direction.

6. A liquid supply system comprising:

the liquid supplier according to claim 5;

a supply tube coupled to the injection port; and a tank that contains the liquid and is coupled to the supply tube, wherein the liquid in the tank is supplied to the liquid ejection device.

* * * * *